US009617838B2

(12) United States Patent
Purcell et al.

(10) Patent No.: US 9,617,838 B2
(45) Date of Patent: Apr. 11, 2017

(54) SYSTEM, APPARATUS AND METHOD FOR ARTIFICIAL LIFT, AND IMPROVED DOWNHOLE ACTUATOR FOR SAME

(71) Applicant: PCS Oilfield Services, LLC, Canadian, TX (US)

(72) Inventors: Ed Purcell, Canadian, TX (US); Mark W. Rose, Ft. Worth, TX (US); William W. Jackson, Plano, TX (US); Cole W. Dunnam, Canadian, TX (US)

(73) Assignee: PCS Oilfield Services, LLC, Canadian, TX (US)

( * ) Notice: Subject to any disclaimer, the term of this patent is extended or adjusted under 35 U.S.C. 154(b) by 0 days.

(21) Appl. No.: 15/133,891

(22) Filed: Apr. 20, 2016

(65) Prior Publication Data

US 2016/0305227 A1 Oct. 20, 2016

Related U.S. Application Data

(60) Provisional application No. 62/150,147, filed on Apr. 20, 2015.

(51) Int. Cl.
*E21B 43/12* (2006.01)
*F04B 47/00* (2006.01)

(52) U.S. Cl.
CPC ..... *E21B 43/129* (2013.01); *F04B 47/00* (2013.01)

(58) Field of Classification Search
CPC ..... E21B 43/129
See application file for complete search history.

(56) References Cited

U.S. PATENT DOCUMENTS

| | | | | |
|---|---|---|---|---|
| 5,494,102 | A * | 2/1996 | Schulte | F04B 47/02 166/105.6 |
| 2006/0207759 | A1 | 9/2006 | Bearden et al. | |
| 2008/0087437 | A1* | 4/2008 | Crawford | E21B 43/129 166/369 |
| 2009/0145595 | A1 | 6/2009 | Mazzanti | |
| 2009/0283264 | A1 | 11/2009 | Sponchia | |
| 2010/0300701 | A1 | 12/2010 | Bullen | |
| 2014/0014318 | A1 | 1/2014 | Mail | |

* cited by examiner

*Primary Examiner* — George Gray
(74) *Attorney, Agent, or Firm* — Jeffrey D. Hunt

(57) ABSTRACT

A system, apparatus and method for artificial lift includes a hydraulic downhole rodless pump actuator.

10 Claims, 21 Drawing Sheets

SYSTEM, APPARATUS AND METHOD FOR ARTIFICIAL LIFT, AND IMPROVED DOWNHOLE ACTUATOR FOR SAME

CROSS-REFERENCE TO RELATED APPLICATIONS

This application claims priority to U.S. Provisional Patent Application No. 62/150,147, filed Apr. 20, 2015, which is hereby incorporated by reference in its entirety.

FIELD OF THE INVENTION

The present disclosure relates to a system, apparatus and method for artificial lift. Embodiments relate to a system, apparatus and method for artificial lift including a pump actuator. Embodiments relate to the aforementioned having a hydraulic downhole rodless pump actuator system, apparatus, and methods of use.

BACKGROUND OF THE INVENTION

The disclosed subject matter provides a system, apparatus and method for artificial lift. Embodiments provide a system, apparatus and method for artificial lift including a hydraulic downhole rodless pump actuator. Embodiments may comprise an actuator for pumping or lifting crude oil, hydrocarbons or fluids ("fluids") from an underground area in a production well. Embodiments may provide a well comprising a hydraulic downhole rodless pump actuator, and method for artificial lift for production of hydrocarbons from a well.

BRIEF SUMMARY OF THE INVENTION

The disclosed subject matter provides a system, apparatus and method for artificial lift. Embodiments of disclosed subject matter provide a system, apparatus and method for artificial lift including a hydraulic downhole rodless pump actuator. Embodiments may provide energy and cost savings, reduced maintenance, reduced maintenance time, reduced maintenance expense, reduced complexity, increased precision of control, increased precision of actuation, increased useful life of artificial lift equipment, reduced mechanical loads on equipment, and apparatus and systems of simplified construction and operation.

These and other advantages of the disclosed subject matter, as well as additional novel features, will be apparent from the description provided herein. The intent of this summary is not to be a comprehensive description of the subject matter, but rather to provide a short overview of some of the subject matter's functionality. Other systems, methods, features and advantages here provided will become apparent to one with ordinary skill in the art upon examination of the following FIGURES and detailed description. It is intended that all such additional systems, methods, features and advantages included within this description, be within the scope of the claims.

BRIEF DESCRIPTION OF THE DRAWINGS

Novel features believed characteristic of the disclosed subject matter will be set forth in any claims that are filed. The disclosed subject matter itself, however, as well as modes of use, further objectives, and advantages thereof, will best be understood by reference to the following detailed description of illustrative embodiments when read in conjunction with the accompanying drawings, wherein:

DETAILED DESCRIPTION OF ILLUSTRATIVE EMBODIMENTS

Reference now should be made to the drawings, in which the same reference numbers are used throughout the different figures to designate the same components.

It will be understood that, although the terms first, second, third, etc. may be used herein to describe various elements, these elements should not be limited by these terms. These terms are only used to distinguish one element from another element. Thus, a first element discussed below could be termed a second element without departing from the teachings of the present disclosure.

The terminology used herein is for the purpose of describing particular embodiments only and is not intended to be limiting. As used herein, the singular forms "a", "an", and "the" are intended to include the plural forms as well, unless the context clearly indicates otherwise. It will be further understood that the terms "comprises" and/or "comprising" or "includes" and/or "including" when used in this specification, specify the presence of stated features, regions, integers, steps, operations, elements, and/or components, but do not preclude the presence or addition of one or more other features, regions, integers, steps, operations, elements, components, and/or groups thereof.

Unless otherwise defined, all terms (including technical and scientific terms) used herein have the same meaning as commonly understood by one of ordinary skill in the art to which this disclosure belongs. It will be further understood that terms, such as those defined in commonly used dictionaries, should be interpreted as having a meaning that is consistent with their meaning in the context of the relevant art and the present disclosure, and will not be interpreted in an idealized or overly formal sense unless expressly so defined herein.

The use of any and all examples, or exemplary language (e.g., "such as"), is intended merely to better illustrate the disclosure and does not pose a limitation on the scope of the disclosure unless otherwise claimed. No language in the specification should be construed as indicating any non-claimed element as essential to the practice of the disclosure as used herein.

Illustrated in the FIGURES are embodiments of subject matter including a system, apparatus and method for artificial lift. Embodiments provide a system, apparatus and method for artificial lift including a hydraulic downhole rodless pump actuator. Embodiments may comprise an actuator that may extract crude oil, hydrocarbons or fluids from an underground area. One of ordinary skill will understand that embodiments may be attached to existing oil field production downhole plunger pumps of a traditional design, and may replace existing sucker rod configurations. In embodiments, system and apparatus for artificial lift may be self-contained with the plunger pump and the rodless actuator being one continuous device which is may be threaded together.

Figure 1A:
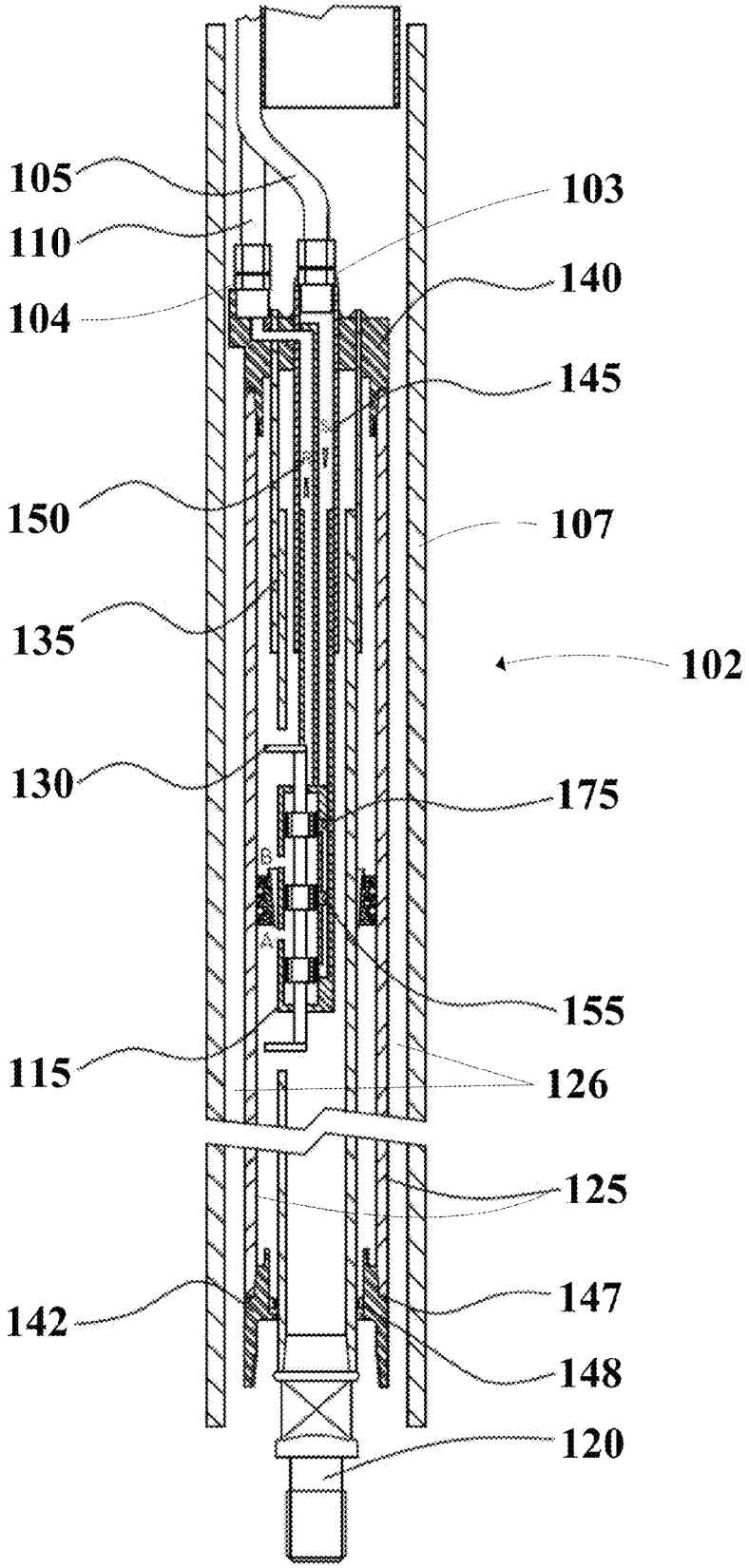
FIG. 1A depicts a partial cross-section view of a system for artificial lift including apparatus having a hydraulic downhole rodless pump actuator in accordance with embodiments.

FIG. 1A depicts a partial cross-section view of a system 100 for artificial lift including an apparatus having a hydraulic downhole rodless pump actuator 102 in accordance with embodiments. The system 100 may include a hydraulically operated plunger pump "actuator" 102 and may exclude a sucker rod string, as typically found on a downhole pump actuator. The primary elimination of the sucker rod allows for a lighter and more efficient system 100. Elimination of the sucker rods may also greatly reduce the horsepower requirement of the system 100, and reduce the cost of surface mounted pumping equipment and sucker rods.

Referring to FIG. 1A, in system 100, the hydraulic downhole rodless pump actuator 102 of FIG. 1A may include an inlet capillary line 105 and an outlet capillary line 110 running down hole to the pump actuator 102. The capillary lines 105,110 may be intended to provide hydraulic fluid from the hydraulic pressure equipment (not depicted) at the surface down to the spool valve 115. This design may allow for or control hydraulic fluid in the capillary lines 105,110 to always be in the same direction, so that the inlet 103 may always flow into the pump actuator 102, while the outlet 104 may always flow out of the pump actuator 102. The reversing of the actuator 102 may be accomplished via spool valve 130 contained within a plunger pump 115. As pressurized hydraulic fluid (not depicted) enters the actuator 102 from the surface thru inlet capillary line 105, the hydraulic fluid may travel through a section inside of the actuator rod 120. Actuator rod 120 may contain an inlet capillary tube 145 affixed to capillary line 105. Hydraulic fluid may eventually find its way to the spool valve 115. The hydraulic fluid may enter the plunger pump 130 through supply port (155). It is noted that components within the pump actuator 102 in conjunction with the spool valve 115 may act as pump plunger 130.

Figure 1B:
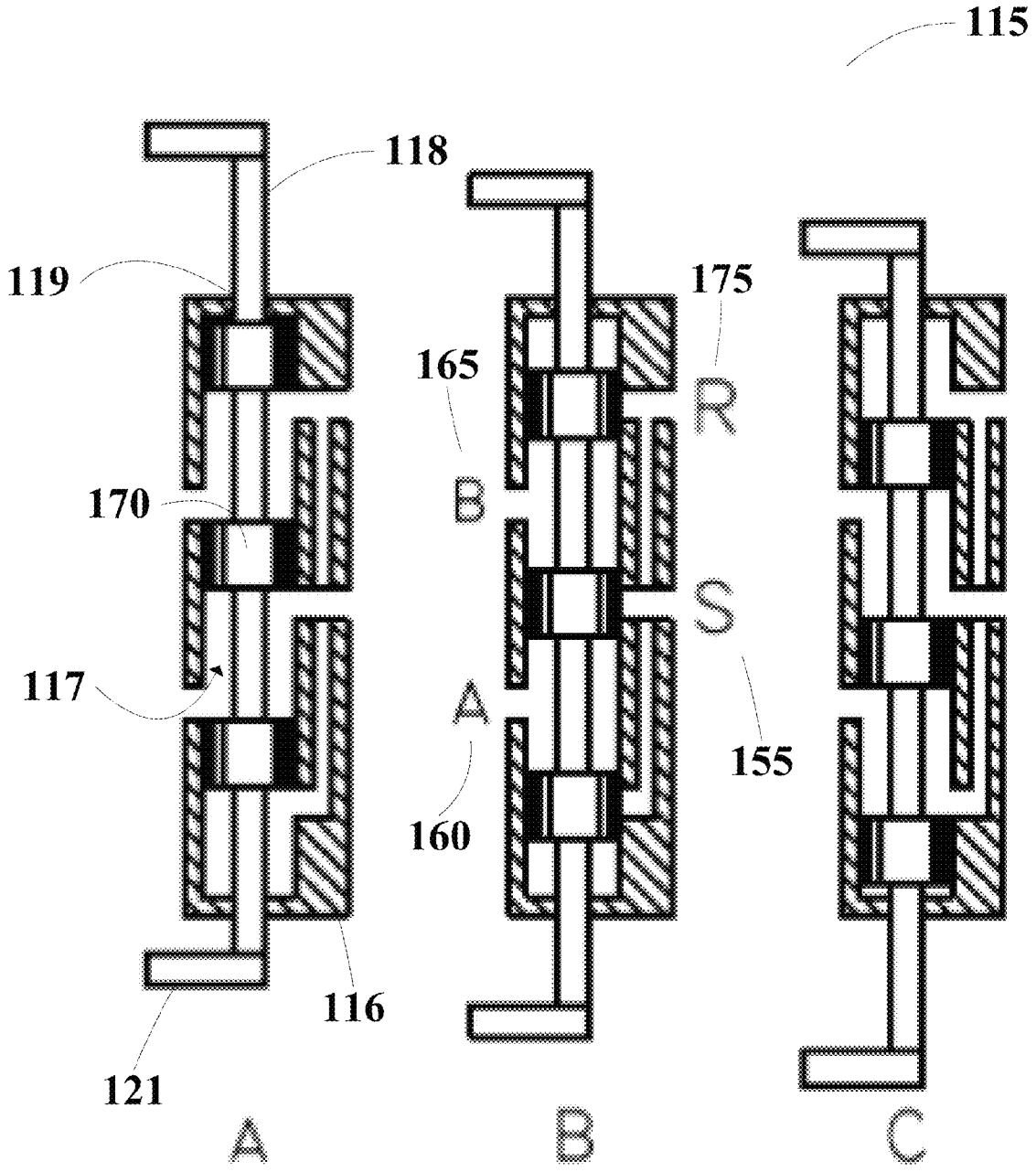
FIG. 1B displays three depictions of a plunger pump containing spool valves in embodiments of a system for artificial lift including an apparatus having a downhole rodless pump actuator.

FIG. 1B displays three depictions of a plunger pump 115. Plunger pump 115 may include spool valves (130) found within embodiments of a system for artificial lift including an apparatus having a downhole rodless pump actuator 102. In the embodiment of plunger pump 115 depicted in FIG. 1B, the hydraulic fluid may flow from supply port S 155 to outlet port A or B 160,165 depending on which way the spool valve 130 is shifted. In view A, the valve 130 is shifted in a lifting position, so the hydraulic fluid may flow under the middle piston 170, which may cause a resultant force to lift the middle piston 170 and produce hydraulic fluid from the plunger pump 115. When the tri-piston assembly 117 travels to the top of its stroke, the valve's 130 top lever 118 that protrudes out of the actuator rod 120 via a slot 119 may engage the stand-off 135 that is part of the upper cap 140. The engagement of the top lever 118 may cause the tri-piston assembly 117 to travel in the opposite (downward) direction. This may block access of the hydraulic fluid to both the return port R 175 and supply port S 155, as shown in view B. When the tri-piston assembly 117 travels further downward, the flow of hydraulic fluid may then be directed from supply port S 155 to outlet port B 165, as shown in view C. The hydraulic fluid may then be directed from the bottom of the tri-piston assembly 117 to the top of the tri-piston assembly 117 and the actuator rod 120 is then pushed down causing the plunger pump 115 to reload. It is noted that in both instances where the supply port S 155 is open (view A and view B), the hydraulic fluid being displaced by the middle piston 170 may be returned to return port R 175 on the plunger pump 115 and sent to the surface via the outlet capillary tube 150, as shown in FIG. 1.

Production fluid flowing from the plunger pump 115 may flow to the surface through the annular area 126 surrounding actuator housing 125 inside of the well casing 107. Both the upper and lower caps 140,142 may comprise O-ring seals 147 on the actuator housing 125 and pressure and wiper seals 148 on the actuator rod 120. The ability of the directional control valve to function properly may be dependent upon the sliding of the actuator rod 120 within the pump actuator 102 in order to allow for the top and bottom levers 118,121 of the spool valve 115 to come in contact with the upper and lower caps 140,142. This contact may shift the valve 115 at the end of its stroke, as shown in FIG. 1A.

Referring to FIG. 1B, in embodiments, the spool valve 115 may comprise a housing 116, a tri-piston assembly 117, at least two ports (such as, but not limited to outlet ports A and B 160,165, supply port S 155, and return port R 175, and at least two levers (top and bottom levers 118,121). In embodiments, the spool valve may be affixed to a portion of the interior surface of the actuator rod.

Figure 2:
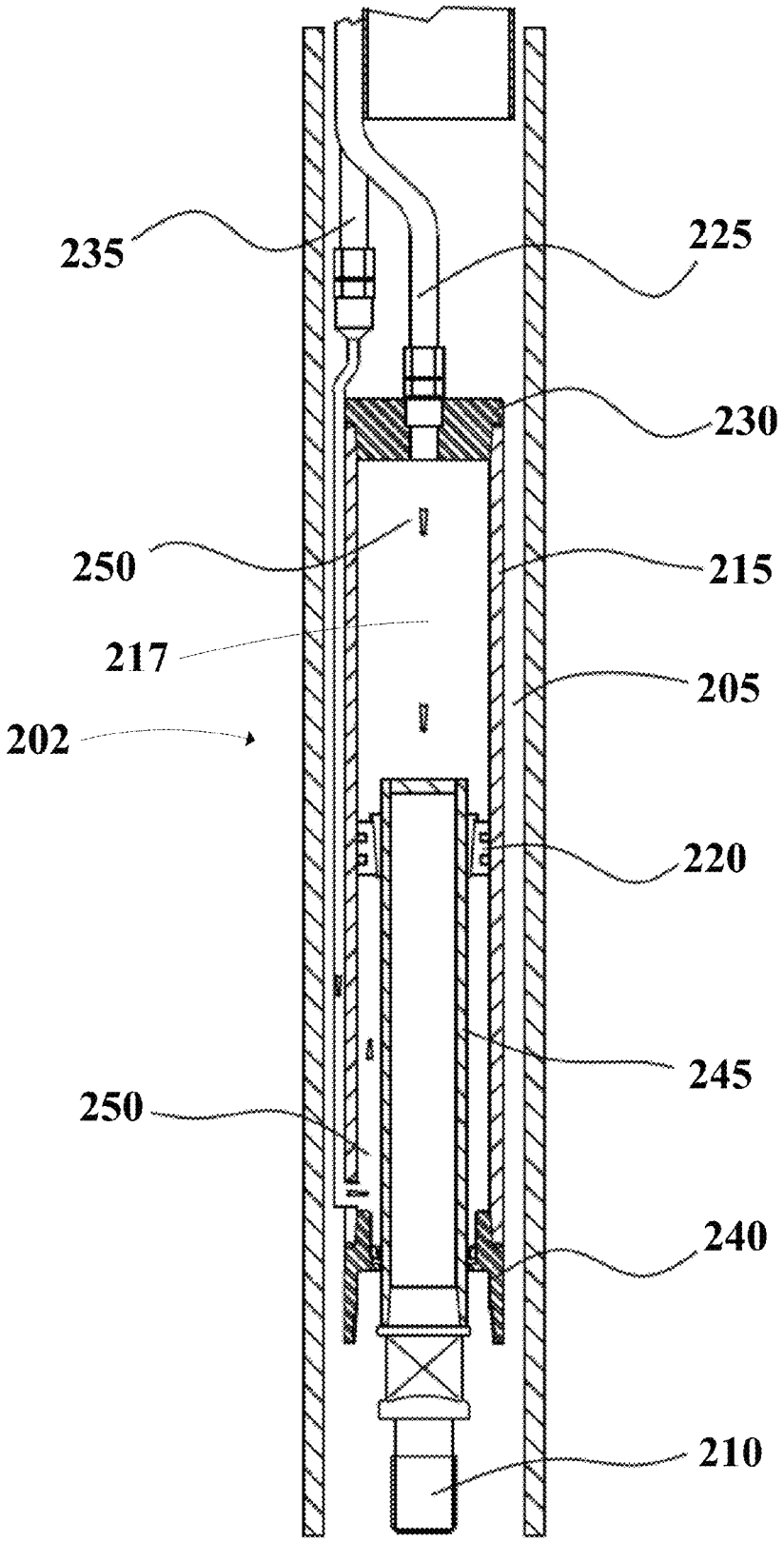
FIG. 2 depicts a partial cross-section view of a system for artificial lift including apparatus having a hydraulic downhole rodless pump actuator in accordance with embodiments.

FIG. 2 depicts a partial cross-section view of a hydraulic downhole rodless pump actuator 202 in a system 200 for artificial lift in accordance with embodiments. This embodiment may include a directional control valve (not depicted) as part of the surface equipment. In the embodiment, the pressure spike obtained from the bottoming out of the hydraulic cylinder 205 (including an actuator rod 210 and actuator housing 215) may be read at the top of at least one of the inlet capillary tube 225 and the adjacent capillary tube 235, and the directional control valve may be shifted. The hydraulic fluid 250 (depicted with arrows) may travel thru the inlet capillary tube 225 and may enter the upper cap 230. The hydraulic fluid 250 may flow into the actuator housing 215 and may create pressure inside the cylinder space 217 of the actuator housing 215, which may result in a force on the area equal to the actuator rod 210 and the piston assembly 220. This force may push the actuator rod 210 down to the bottom of the actuator housing 215 and cause the attached plunger pump cylinder 245 to reload. At this point, the surface mounted directional control valve may shift and the flow may reverse so that the fluid 250 may now enter the adjacent capillary tube 235. This may cause the force created by the resultant pressure to be exerted on the bottom side of the piston 220 and the top of the bottom cap 240 that may raise the actuator rod 210 attached to the plunger pump cylinder 245. The oscillating of the actuator rod 210 may run the plunger pump 205 so that production fluid 250 may be produced in the annular area surrounding the actuator rod 210 and up into the production tubing.

It is noted that, in embodiments, the hydraulic cylinder 205 and its components may be utilized as a plunger pump.

Regarding FIG. 2, in embodiments, the adjacent capillary tube 235 may be affixed to at least a portion of the hydraulic cylinder 205 throughout the period of upward and downward movement of the plunger pump cylinder 245. This may be due to additional length in the adjacent capillary tube 235 or the ability for the adjacent capillary tube 235 to extend and retract.

Figure 3:
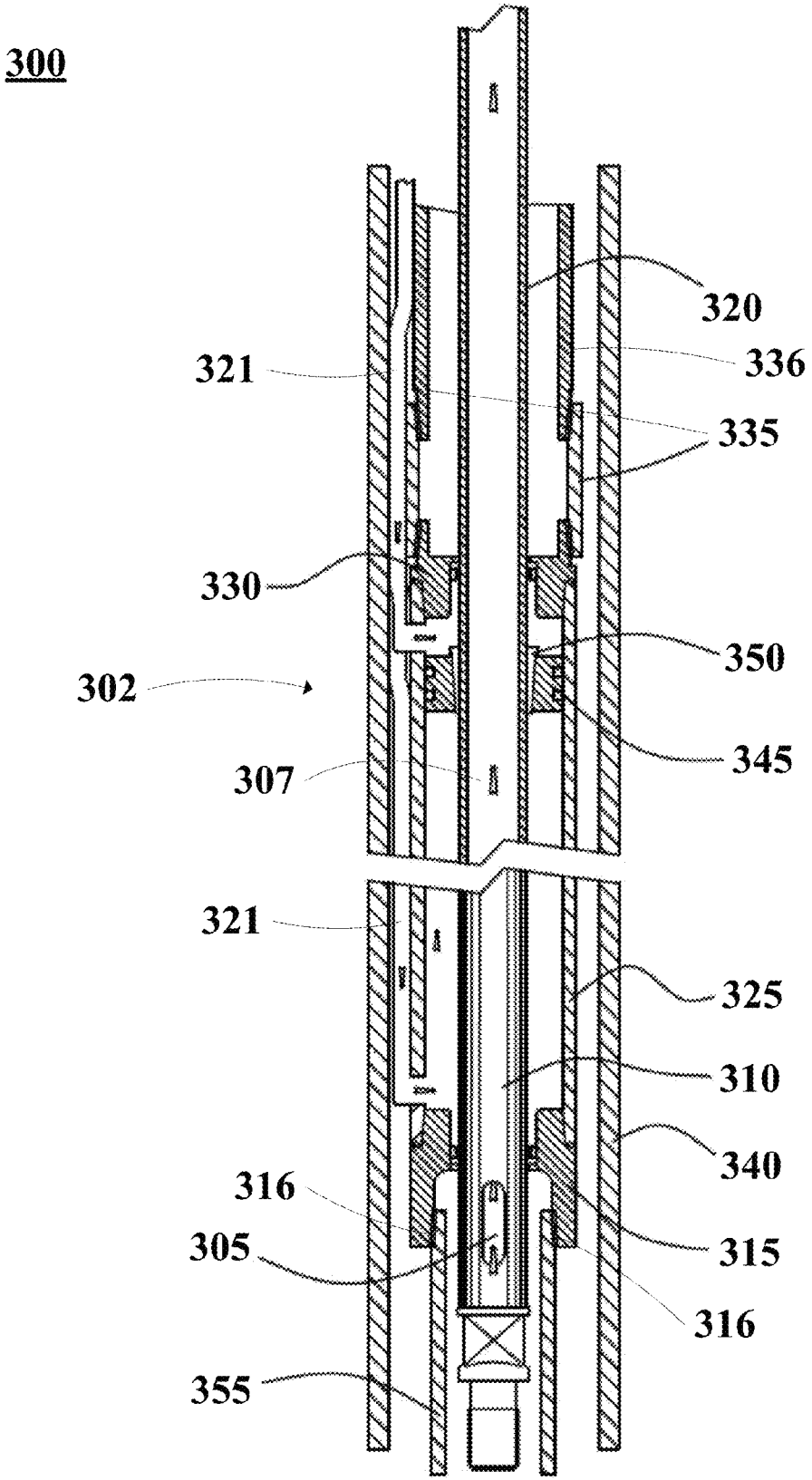
FIG. 3 depicts a partial cross-section view of a system for artificial lift including apparatus having a hydraulic downhole rodless pump actuator in accordance with embodiments.

FIG. 3 depicts a partial cross-section view of a hydraulic downhole rodless pump actuator 302 in a system 300 for artificial lift in accordance with embodiments. The embodiment of FIG. 3 may be thought of as a structurally more complex actuator 302 than the embodiment of the actuator 202 found in FIG. 2. The production fluid 307 (depicted with arrows) found in this embodiment may flow into an opening (305) in the actuator rod 310. The production fluid 307 may then be injected directly into the actuator tubing 325. The actuator tubing 325 may be attached directly to the lower cap 315 and the produced fluid may flow thru the hollow actuator rod 320 found within the actuator tubing 325. Capillary tubes 321 may be attached to the actuator tubing 325 just adjacent to the lower cap 315 and the upper cap 330. The pump actuator 302 may attach directly to production tubing 336 via a standard coupling 335. The pump actuator 302 may further include well casing 340. The force from the hydraulic pressure may be applied to the bottom of the piston 345 when the pump actuator 302 is in the raising mode. This may cause the piston wedge 350 to tighten its grip upon the actuator rod 310. A lower actuator tubing 355 may surround the actuator rod 310 and may be affixed to a bottom portion 316 of the lower cap 315.

Figure 4A:
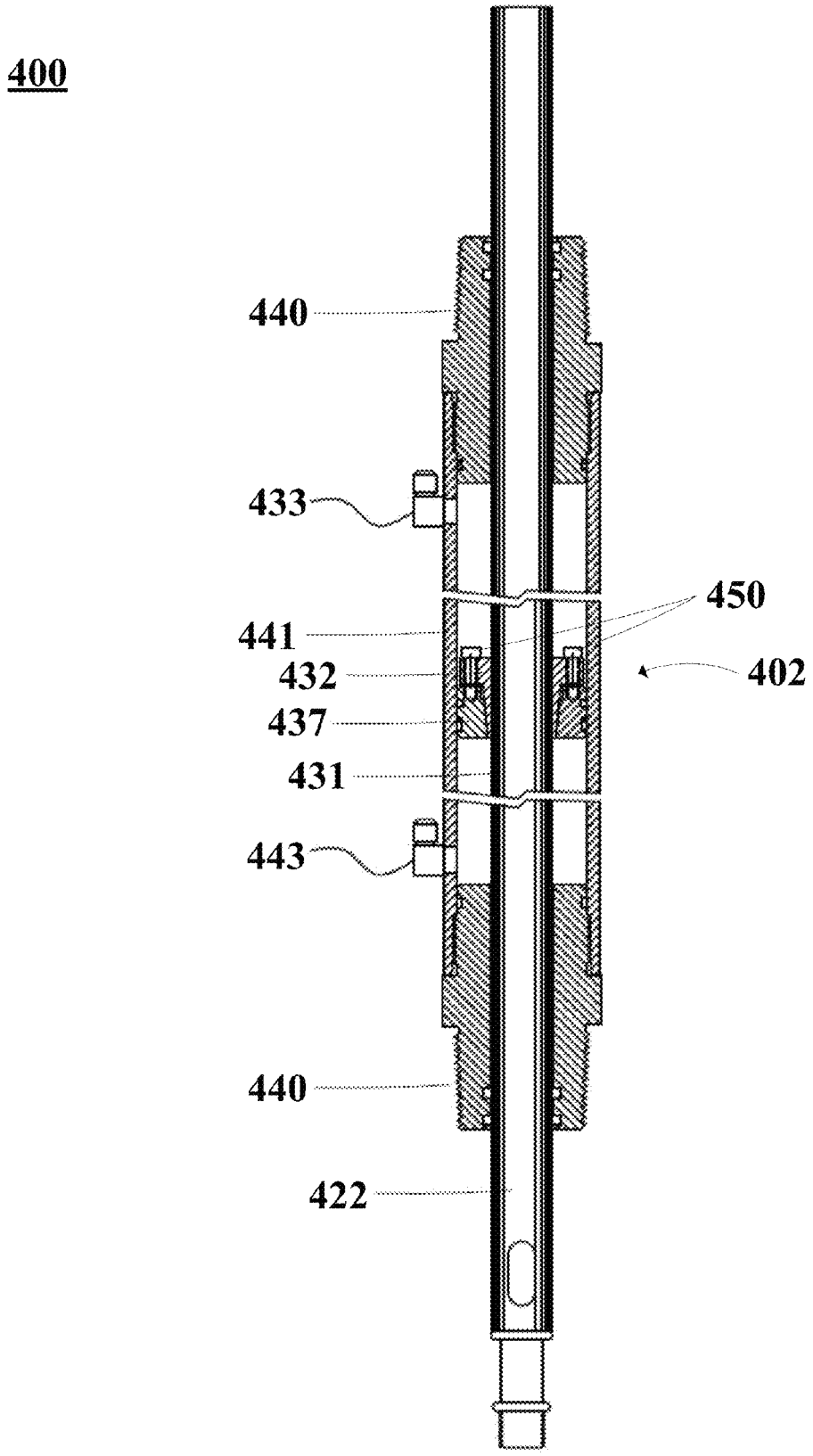
FIG. 4A depicts a partial cross-section view of a system for artificial lift including apparatus having a hydraulic downhole rodless pump actuator in accordance with embodiments.
Figure 4B:
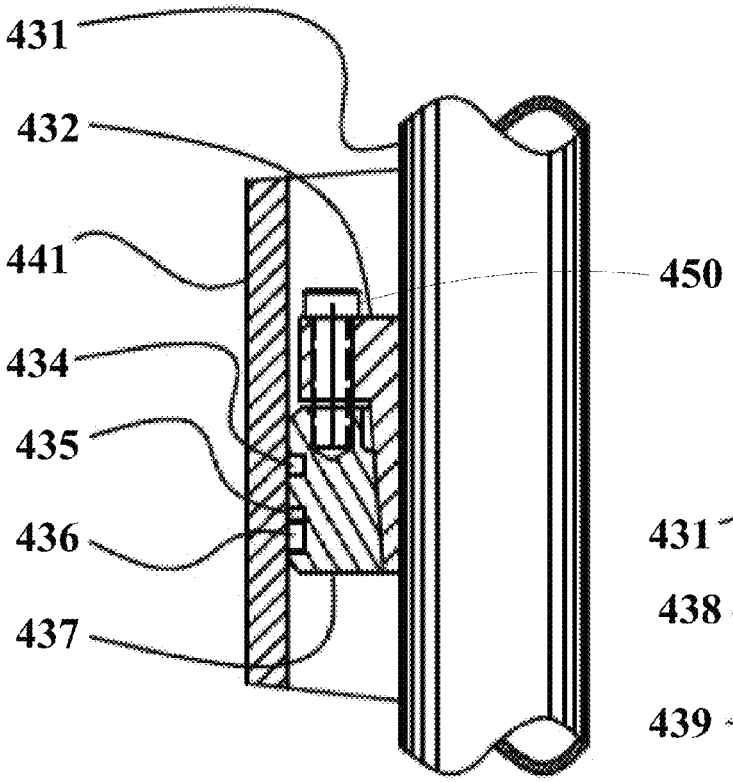
FIG. 4B depicts an enlarged view of a section of an actuator rod and its engagement to a piston in a system for artificial lift including apparatus having a downhole rodless pump actuator in accordance with embodiments.
Figure 4C:
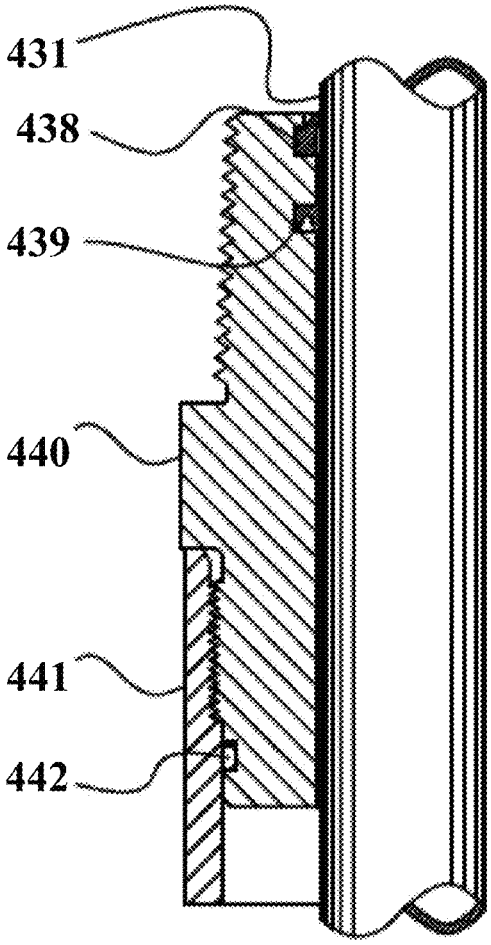
FIG. 4C depicts an enlarged view of an end cap in engagement with an actuator housing in a system for artificial lift including apparatus having a downhole rodless pump actuator in accordance with embodiments.

FIG. 4A depicts a partial cross-section view of a hydraulic downhole rodless pump actuator 402 in a system 400 for artificial lift in accordance with embodiments. The embodiment found in FIG. 4A may be a simplified embodiment that may include the actuator housing 441, actuator rod 431, symmetrical end caps 440, piston 437, and piston wedge 432. The piston wedge 432 may be held in place by one or more bolts 450 which may initiate the compression and resultant clamping force on the actuator rod 431. Seals 434,436 on the piston 437 may include a pressure seal 436 with a back-up ring 435 and a wiper seal 434, as shown in detail in FIG. 4B. Pressure against the lower or bottom face of the piston 437 may raise the piston 437 and may also tighten the piston wedge 432, which may re-enforce the piston 437 lift capacity. The end caps 440 may be symmetrical and may contain a wiper seal 438, a chevron pressure seal 439 and an O-ring pressure seal 442, as shown in detail in FIG. 4C.

The hydraulic fluid (not depicted) for the actuation of the actuator rod 422 may enter and exit the actuator via 90 degree hydraulic fittings 433,443 welded to the actuator housing 441. The 90 degree hydraulic fittings 433,443 may be attached to standard hydraulic connections (not depicted) located at the end of capillary tubes (not depicted). The operation of the actuator rod 422 in this embodiment may be carried out via the reversing of the flow of the hydraulic fluid from the surface thru a directional control valve (not depicted). The actuator rod 422 may be connected directly to production tubing (not depicted) on the top and a plunger pump (pump actuator 402 minus the actuator rod 422) on the bottom. As with other embodiments, the hydraulic fluid (not depicted) produced by the plunger pump may be flowed through the hollow actuator rod 422 directly into the production tubing. The actuator rod 422 may stroke up into the production tubing during its upstroke. In embodiments, the piston wedge 432 may be held in place by three bolts 450.

Figure 5A:
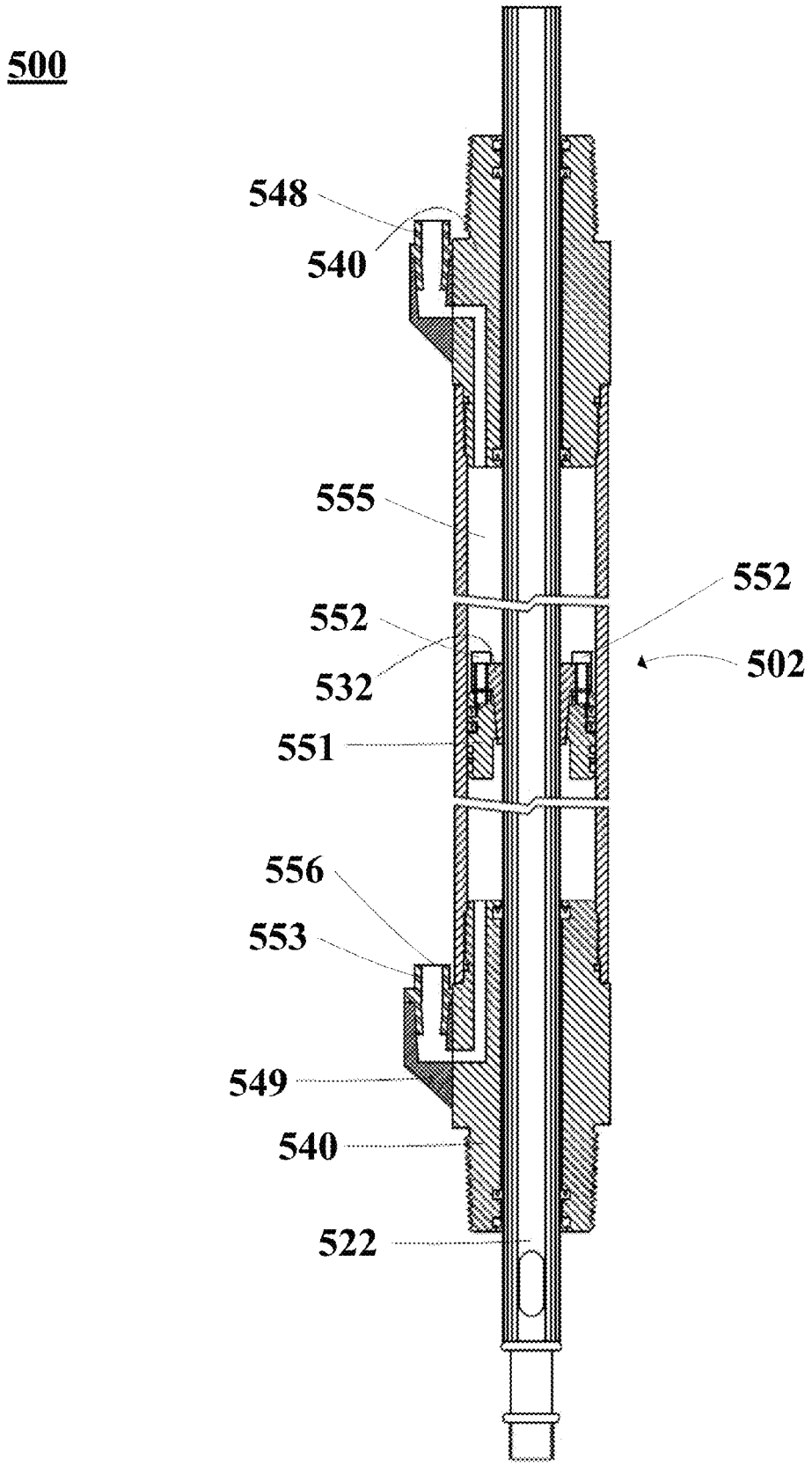
FIG. 5A depicts a partial cross-section view of a hydraulic downhole rodless pump actuator in a system for artificial lift including apparatus having a downhole rodless pump actuator in accordance with embodiments.

FIG. 5A depicts a partial cross-section view of a hydraulic downhole rodless pump actuator 502 in a system 500 for artificial lift in accordance with embodiments. In this embodiment, the pump actuator 502 may be powered on the down stroke by a charge of nitrogen gas (not depicted) which may act as a gas spring from the accumulator effect of having a compressed gas above the piston 551. In the assembly, the piston 551 may be attached to actuator rod 522 via the piston wedge 532 and is retained via a set of bolts 552 and the compression of the hydraulic pressure against the bottom lifting force of the piston 551. The piston 551 may retain a pressure seal 546, a back-up ring 545, and a wiper seal 544, as shown in detail in FIG. 5B.

Figure 5B:
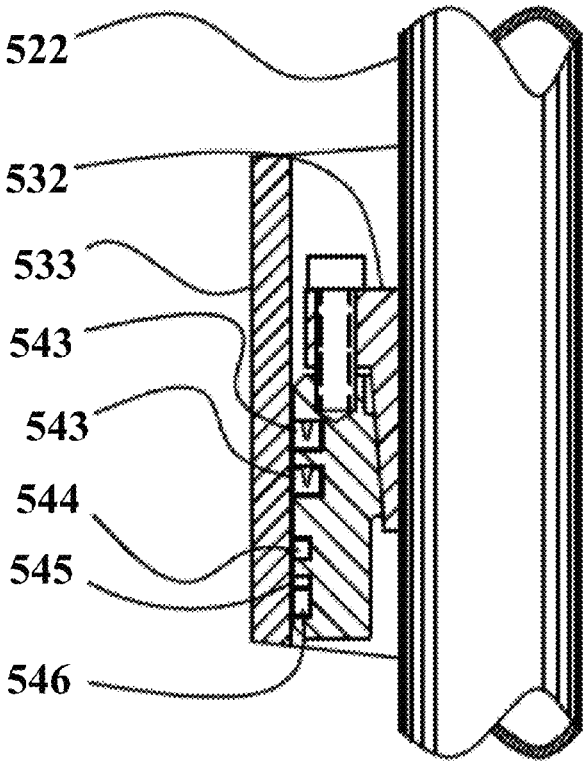
FIG. 5B depicts an enlarged view of a section of an actuator rod and its engagement to a piston in a system for artificial lift including apparatus having a downhole rodless pump actuator in accordance with embodiments.
Figure 5C:
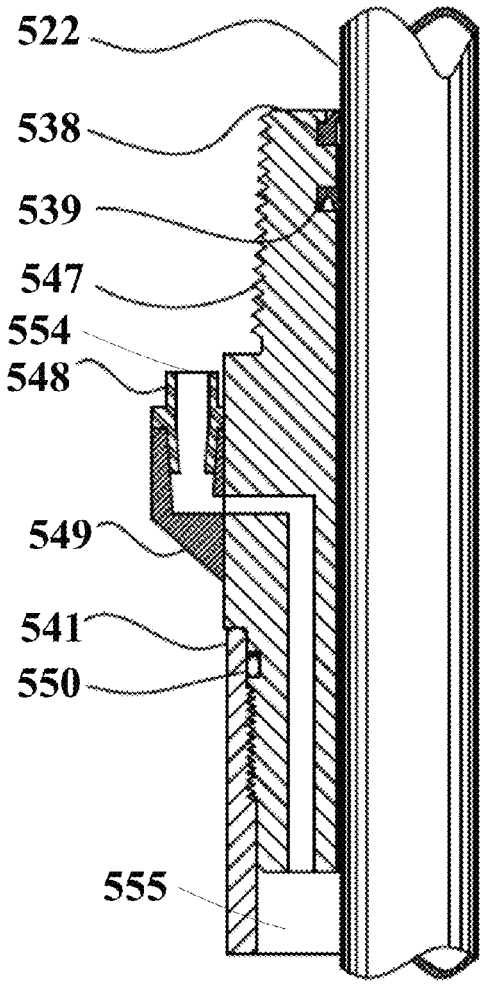
FIG. 5C depicts an enlarged view of an end cap in engagement with an actuator housing in a system for artificial lift including apparatus having a downhole rodless pump actuator in accordance with embodiments.

Added to the piston 551 may be two chevron gas seals 543 facing up so as to be expanded by the nitrogen gas, as shown in detail in FIG. 5B. The end caps 540 of the pump actuator 502 may be symmetrical with the exception that the capillary connection blocks 549 may be reversed so that they may both point in the up-hole direction, similar to the embodiments found in FIG. 1 and FIG. 3. The blocks 549 (as shown in FIG. 5C) may be welded onto the end caps 540 prior to assembly of the pump actuator 502. The capillary ends 547 may contain a wiper seal 538, pressure seals 539, an O-ring pressure seal 550, and a port 554 drilled for the insertion of the nitrogen gas and the inlet 548 and outlet 553 (FIG. 5A) of the hydraulic fluid (FIG. 5C). The nitrogen gas at a raised pressure may be inserted into the upper chamber 555 of the pump actuator 502 via the capillary connection block 549 welded to the upper cap 540. The block 549 may be open to the tapered thread end of the end cap 540 so as to allow easy connection of a capillary tube (not depicted). This may result in a gas shock/spring on the top of the piston 551 that may push the piston 551 down, refilling the plunger pump (pump actuator 502 minus the actuator rod 522) on the down stroke. The lower cap 540 may have the capillary block 549 welded on with the opening 556 pointing toward the straight threaded end. Opening 556 may be the port through which the hydraulic fluid may be pumped into in order to raise the piston 551 and may also be used to allow the hydraulic fluid to be returned to the surface. As in other embodiments, the production fluid (not depicted) produced by the plunger pump may be flowed through the hollow actuator rod 522 directly into production tubing (not depicted). The actuator rod 522 may stroke up into the production tubing during its upstroke.

Figure 6A:
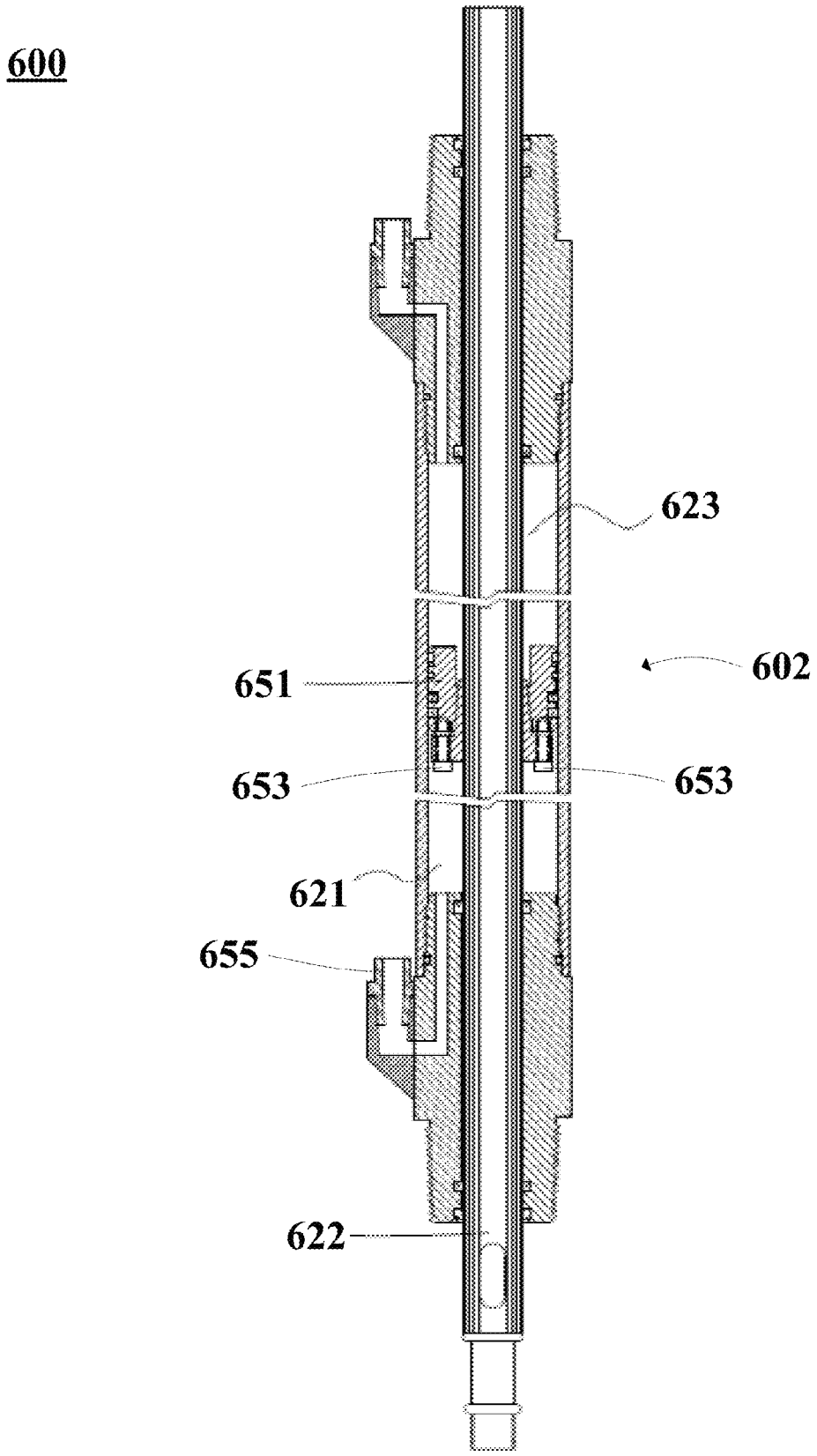
FIG. 6A depicts a partial cross-section view of a hydraulic downhole rodless pump actuator in a system for artificial lift including apparatus having a downhole rodless pump actuator in accordance with embodiments.

FIG. 6A depicts a partial cross-section view of a hydraulic downhole rodless pump actuator 602 in a system 600 for artificial lift in accordance with embodiments. In this embodiment, the location of gas space 621 may be reversed when compared to other embodiments. The gas space 621 may provide for nitrogen gas to be injected into and contained in the gas space 621 at the bottom of the pump actuator 602 with the power on the up stroke being provided by the gas pressure acting upon the bottom face area of the piston 651. Gas space 621 may be sealed at the end of the above ground capillary tube (not depicted) and may act as a type of gas spring. As a result, the actuator rod 622 may then be lifted and the plunger pump (pump actuator 602 minus the actuator rod 622) may be made to deliver production fluid (not depicted) to the surface as shown in FIG. 1. In this instance, the actuator rod 622 may be hollow and the production fluid may flow through the actuator rod 622 and into the production tubing. Once the actuator rod (622) is in the up position, hydraulic fluid 623 may be sent to the actuator upper chamber 623 located at the top of the pump actuator 602 and there it acts upon the top face area of the piston 651, driving the actuator rod 622 down. At the end of its stroke, the actuator rod 622 may stop and an above ground valve (not depicted) may open and may allow the hydraulic fluid 623 to travel back out of the actuator upper chamber 623 and through inlet 648 attached at the upper cap 647 at the weld cap 649 as shown in FIG. 6B.

Figure 6B:
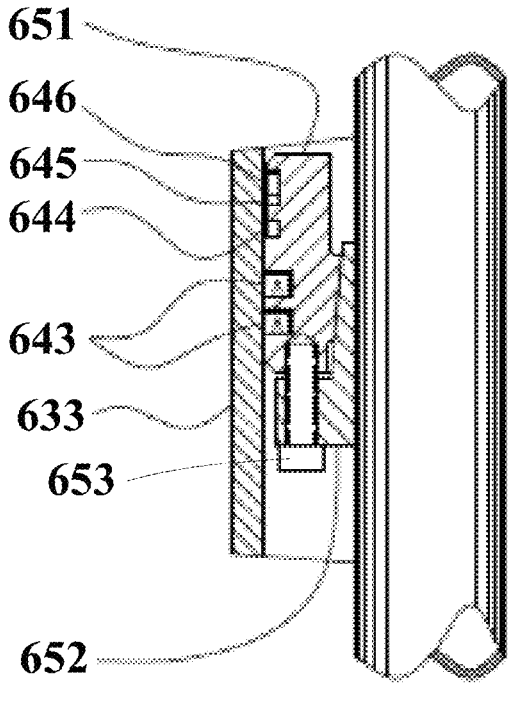
FIG. 6B depicts an enlarged view of a section of an actuator rod and its engagement to a piston in a system for artificial lift including apparatus having a downhole rodless pump actuator in accordance with embodiments.
Figure 6C:
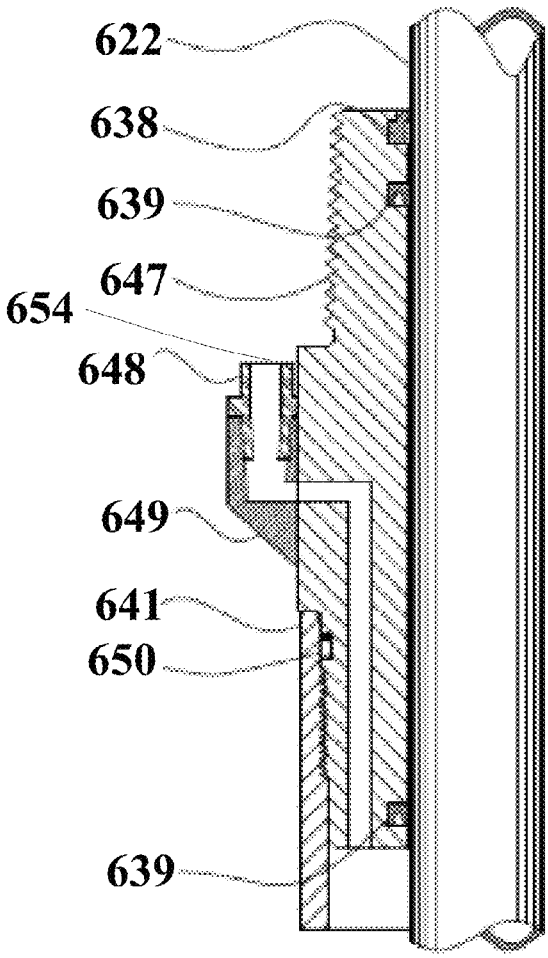
FIG. 6C depicts an enlarged view of an end cap in engagement with an actuator housing in a system for artificial lift including apparatus having a downhole rodless pump actuator in accordance with embodiments.

As before, the piston 651 may be sealed to the hydraulic side of the pump actuator 602 via a piston seal 646, a back-up ring 645, and a wiper seal 644 (FIG. 6B). Added to the piston 651 may be two chevron gas seals 643 that may face up so as to be expanded by the nitrogen gas (FIG. 6B). In the assembly, the piston 651 may again be attached to actuator rod 631 via the piston wedge 652 and may be retained via a set of bolts 653 and the compression of the nitrogen gas pressure against the face of the piston 651. The end caps 647 of the actuator housing 633 may contain a wiper seal 638, pressure seals 639, an O-ring pressure seal 650, and a port 654 drilled for the insertion of the nitrogen gas into gas space 621 and the inlet 648 and outlet 655 of the hydraulic fluid 648 (FIG. 6C). As with other embodiments, the production fluid (not depicted) produced by the plunger pump may be flowed through the hollow actuator rod 631 directly into the production tubing (not depicted). The actuator rod 631 may stroke up into the production tubing during its upstroke.

Figure 7A:
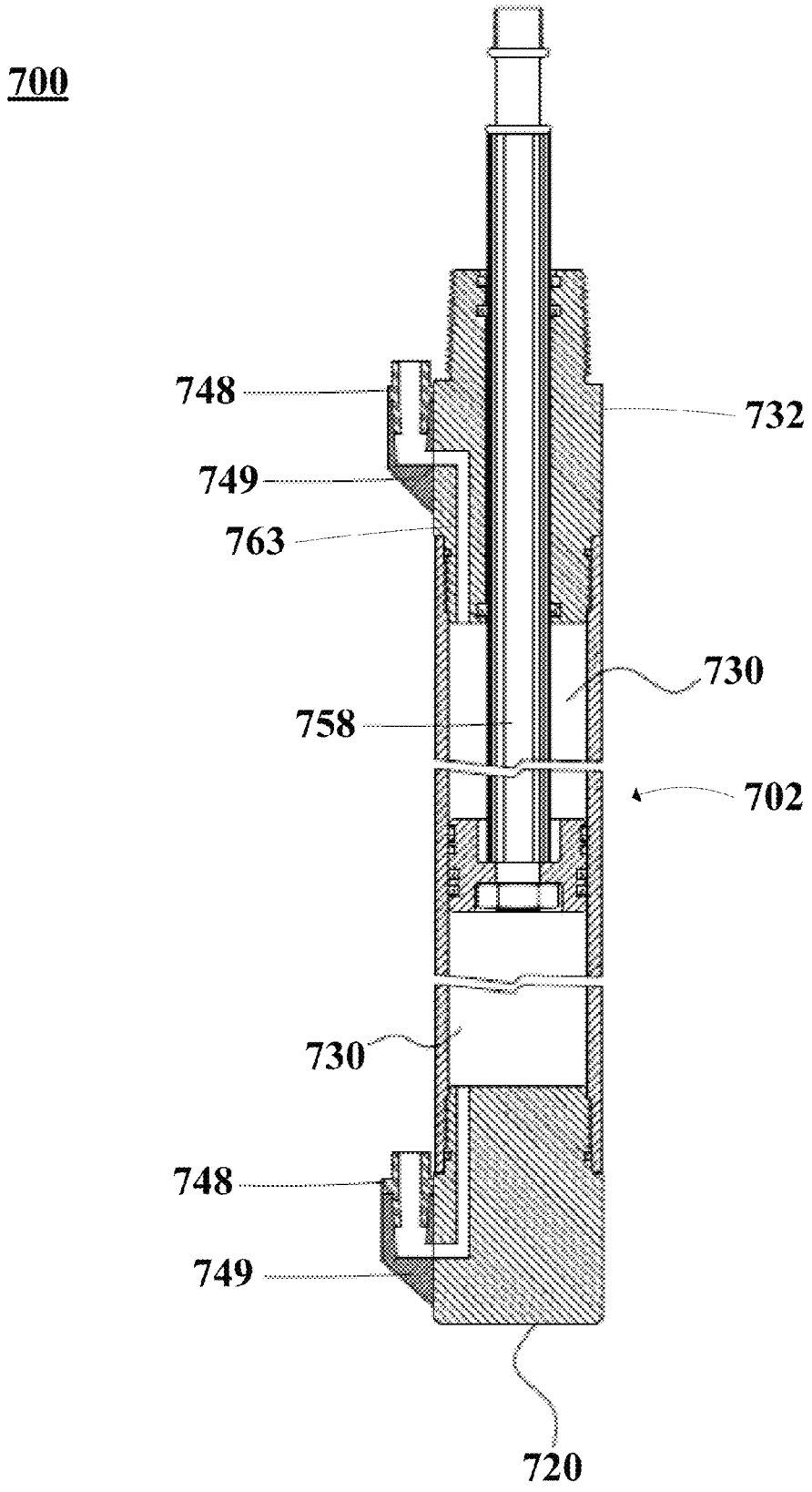
FIG. 7A depicts a partial cross-section view of a hydraulic downhole rodless pump actuator in a system for artificial lift including apparatus having a downhole rodless pump actuator in accordance with embodiments.

FIG. 7A depicts a partial cross-section view of a hydraulic downhole rodless pump actuator 702 in a system 700 for artificial lift. In this embodiment, the configuration of the pump actuator 702 may be reversed with the plunger pump (pump actuator 702 minus actuator rod 758) reversed within the pump actuator 702 in the well. The actuator rod 758, in this configuration, may exit the pump actuator 702 only on the top and may extend into the bottom of the pump actuator 702 and may connect to the plunger pump. The plunger pump may be stroked to the full capacity of the plunger's stroke within the pump actuator 702.

As shown in FIG. 7A, the lower chamber 730 of the pump actuator 702 may be filled via its capillary connection 748 which is mounted at its welded mount 749 to the upper end cap 732 and the lower end cap 720. The upper end cap 732 may have a capillary fitting 763 which may connect the upper chamber to the hydraulic circuit (not depicted) supplied from an above ground hydraulic power source (not depicted). This hydraulic power source may be used to power the hydraulic fluid (not depicted) which may drive the piston 753 down and in turn may cause the refilling of the plunger pump. The upper cap may have seals that may seal off the vertical actuator shaft 758 at the wiper seal 738 and the pressure seal 739. Also present may be a pressure seal 750 at the bottom of the upper end cap 732. In embodiments, the actuator housing 754 may comprise a top end 741 that may be configured to receive at least a portion of the upper end cap 732. In embodiments, the upper end cap 732 may comprise a threaded portion 747 that may be utilized to affix the upper end cap 732 to another portion of a hydraulic pump.

Figure 7B:
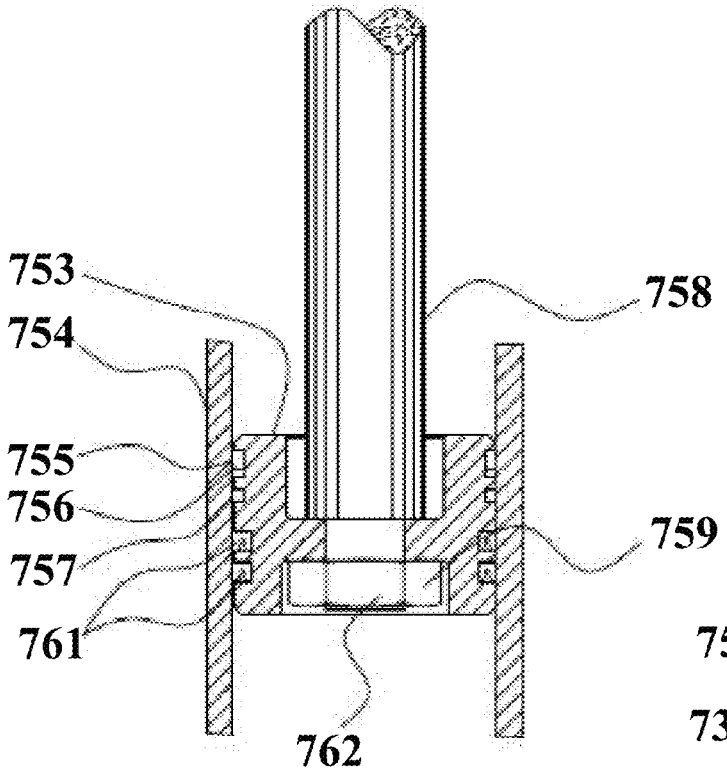
FIG. 7B depicts an enlarged view of a section of an actuator rod and its engagement to a piston in a system for artificial lift including apparatus having a downhole rodless pump actuator in accordance with embodiments.

FIG. 7B depicts an enlarged view of a section of an actuator rod 758 and its engagement to a piston 753 in a system 700 for artificial lift. The bottom cap 720, in embodiments, may have acenter port (not depicted) through which the actuator rod 758 may pass. Instead, the actuator rod 758 may end at the piston 753 and may be in compression loading while stroking the plunger pump. The piston 753 may be attached to the actuator rod via a nut 762. The actuator rod 758 in this application may be solid and threaded to accept the piston 753 and retaining nut 762 mounted on the bottom end. The actuator rod 758 may be fitted with an API sucker coupling connection (not depicted) on the top end. The piston 753 may travel vertically through the actuator housing 754 and seal at the top against the hydraulic pressure with a piston seal 755 and a back-up ring 756. The gas pressure side of the piston 753 may be sealed via two chevron gas rings 761. In embodiments, additional piston seals 755,757 may be utilized by piston 753.

Figure 7C:
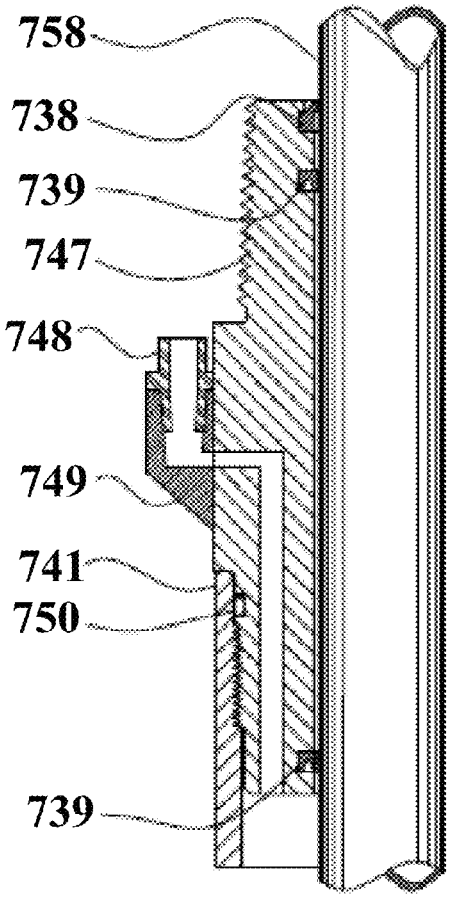
FIG. 7C depicts an enlarged view of an end cap in engagement with an actuator housing in a system for artificial lift including apparatus having a downhole rodless pump actuator in accordance with embodiments.

The gas pressure supplied through the lower cap capillary connection 748 may exert its pressure against the surface area of the bottom face of the piston 753, the lower cap capillary connection 748 shown in FIG. 7C. The force supplied by the gas pressure in this chamber may raise the piston 753 and hence the plunger pump may be stroked. When the piston 753 has completed its travel, the hydraulic pressure created by the hydraulic fluid not depicted entering the upper chamber 730 may return the piston 753 to the bottom of the pump actuator 702 and may refill the plunger pump, completing the pumping cycle.

Figure 8:
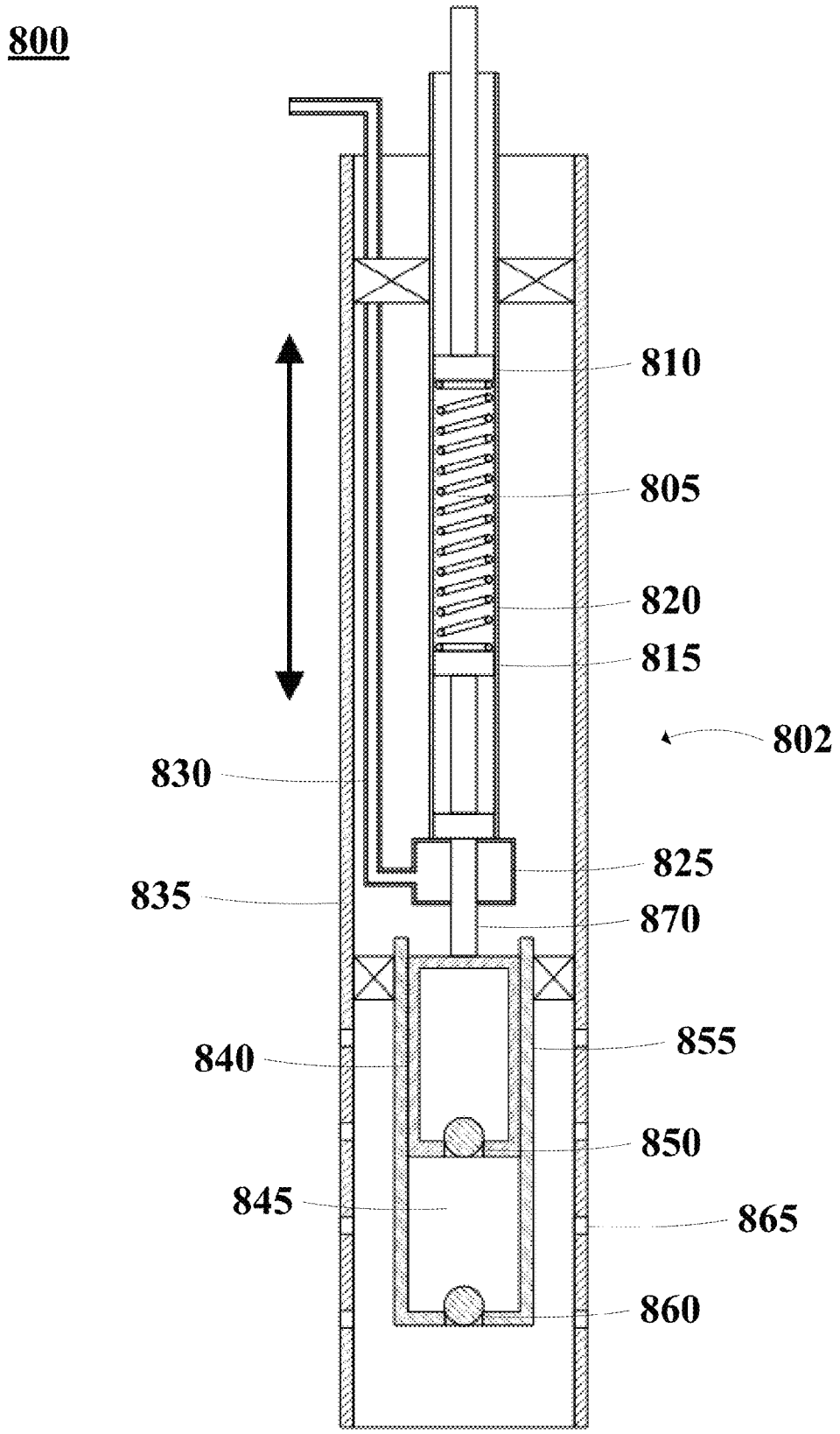
FIG. 8 depicts a partial cross-section view of a hydraulic downhole rodless pump actuator in a system for artificial lift including an apparatus having a downhole rodless pump actuator in accordance with embodiments.

FIG. 8 depicts a partial cross-section view of a hydraulic downhole rodless pump actuator 802 in a system 800 for artificial lift in accordance with embodiments. In embodiments, the pump actuator 802 may comprise a spring mechanism 805 secured between two pistons (top and bottom pistons) 810,815 housed within a return spring chamber 820. Adjacent the bottom of the return spring chamber 820 may be a first transfer chamber 825. The pump actuator 802 may further comprise a pump line 830 that may be affixed to the first transfer chamber 825 and may run adjacent the return spring chamber 820 within the casing 835.

Referring to FIG. 8, the pump actuator 802 may further comprise a traveling valve apparatus 840. The traveling valve apparatus 840 may comprise a second transfer chamber 845, including a traveling valve 850 that may be affixed to a hollow rod 870 attached to the bottom piston 815 (the piston may run through perforations in the first transfer chamber 825). The traveling valve apparatus 840 may further comprise a valve housing 855 that may encapsulate the second transfer chamber 845 and may also comprise a stationary valve 860 found at the bottom interior of the valve housing 855. At least one seal (not depicted) may sealably engage the periphery of the valve housing 855 as well as the interior surface of the casing 835 in order to provide an airtight and water tight barrier that may prevent leakage of hydraulic fluid and/or hydrocarbons or natural gas. A plurality of perforations 865 may exist around the periphery of the casing 835 in proximity to the traveling valve apparatus 840 in order to give the traveling valve apparatus 840 access to production fluid (not depicted).

Referring to FIG. 8, when the spring 805 is actuated via power supplied from a hydraulic power source (not depicted) at the surface of a well and pushed upward, the second transfer chamber 845 may be pulled upward, causing the traveling valve 850 to close and the stationary valve 860 to open and hydrocarbons to flow upward with the second transfer chamber 845. In embodiments, the hydrocarbons may flow directly from the second transfer chamber 845 to the first transfer chamber 825. In embodiments, the hydrocarbons may flow directly from the second transfer chamber 845 into the hollow rod 870 via a portion of the bottom piston 815. In order to carry out the flow of hydrocarbons, the hollow rod 870 may allow flow through the embodiment and above into production tubing not depicted that continues up the wall to the surface.

Referring to FIG. 8, when the spring 805 is actuated in a downward manner, the second transfer chamber 845 may be forced in a downward direction, causing the traveling valve 850 to open and allow hydrocarbons to flow into the second transfer chamber 845 while simultaneously closing the stationary valve 860.

Referring to FIG. 8, in embodiments, a centralizer may be affixed to the exterior surface of the casing 835. In embodiments, the centralizer may center the casing 835 when in a wellbore.

Figure 9A:
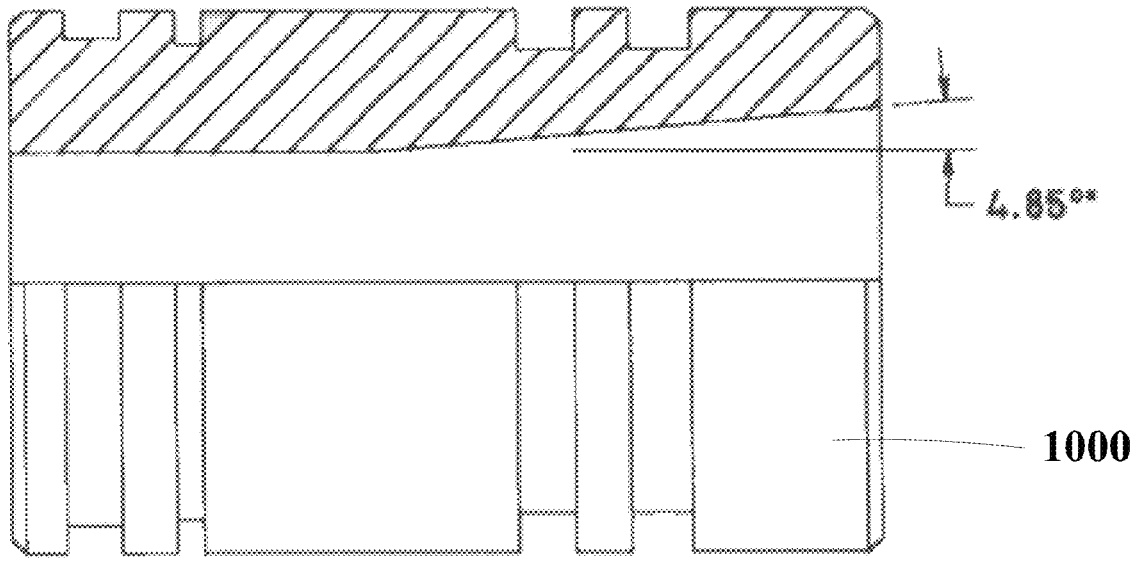
FIG. 9A depicts a partial cross-sectional view of a piston in accordance with embodiments.
Figure 9B:
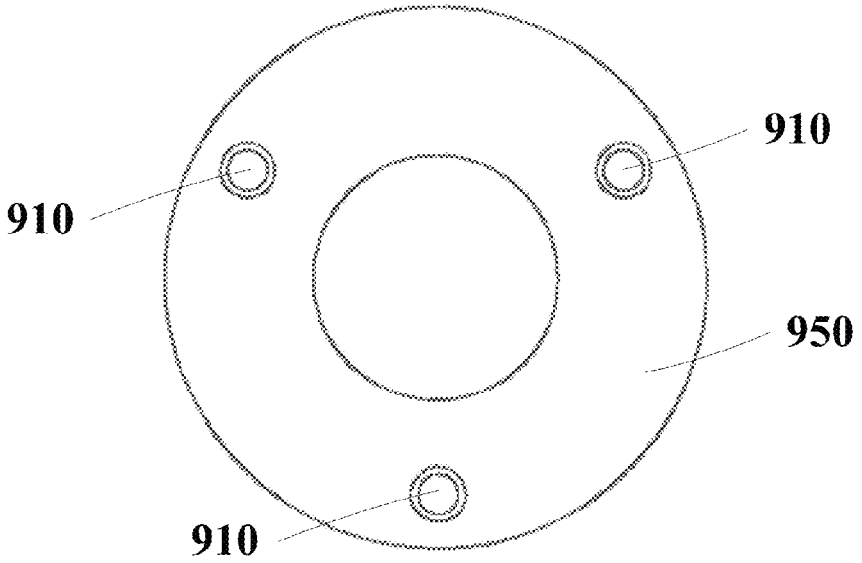
FIG. 9B depicts an enlarged top view of a piston wedge for receiving bolts (not shown) and usable with a piston shown generally in FIG. 9A in downhole rodless pump actuators in accordance with embodiments.
Figure 10A:
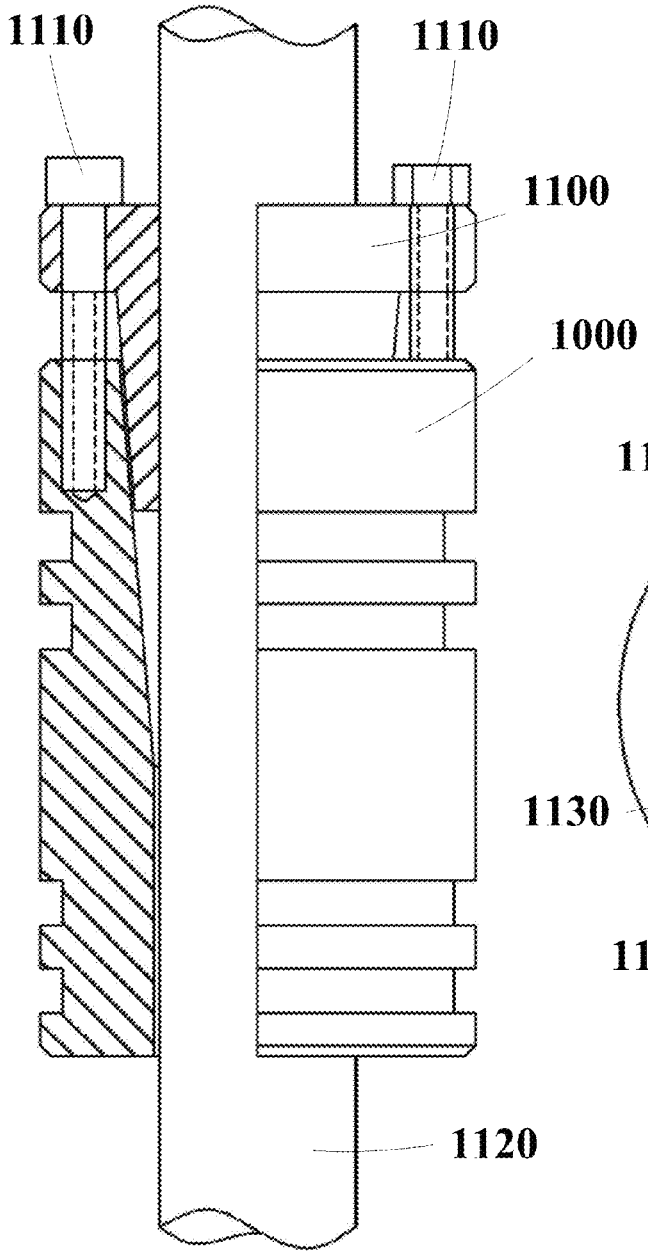
FIG. 10A depicts an enlarged view of a section of an actuator rod and its engagement to a piston in a system for artificial lift including apparatus having a downhole rodless pump actuator in accordance with embodiments.
Figure 10B:
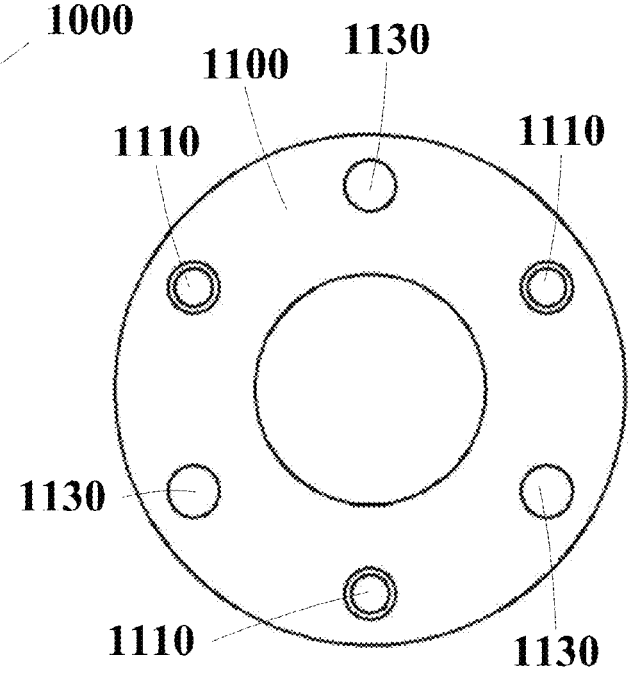
FIG. 10B depicts a top view of a piston wedge shown generally in FIG. 10A, with bolts omitted, in accordance with embodiments.

FIG. 9A depicts a partial cross-sectional view of a piston 1000 in accordance with embodiments. In embodiments, a portion of the interior of the piston 1000 may be hollowed out in a truncated cone shape. The cone shape may increase in diameter until the cone shape meets an edge of the piston 1000. The angle at which the cone shape expands may be, for example, 4.85 degrees. The cone shape may allow a piston wedge 1100 (FIG. 10A) to properly slide and fit at least partially within the piston. A further view of an embodiment of a piston 1000, including a piston wedge 1100, affixed to piping (not depicted) of a downhole rodless pump actuator (see FIG. 3, 4A, 5A, for example) is displayed in FIG. 10A. The piston wedge 1100 may be shown slid into a top portion of the piston 1000. To secure the piston wedge 1100 to the piston 1000, at least one extraction bolt 1110 may be positioned through an outer protrusion of the piston wedge 1100 and into the body of the piston 1000. The piston wedge 1100 may provide a friction seal to the actuator rod 1120 in order to prevent movement of the piston 1000 along the actuator rod 1120. In embodiments, as shown in FIG. 9B, three extraction bolts 910 may be utilized to connect a piston wedge 950 to a piston 1000. In embodiments, as shown in FIG. 10B, three extraction bolts 1110 may be utilized to connect a piston wedge 1100 to a piston 1000. The three remaining holes 1130 may be used to insert bolts 1110 in order to disconnect the piston wedge 1100 from the piston 1000.

Figure 11A:
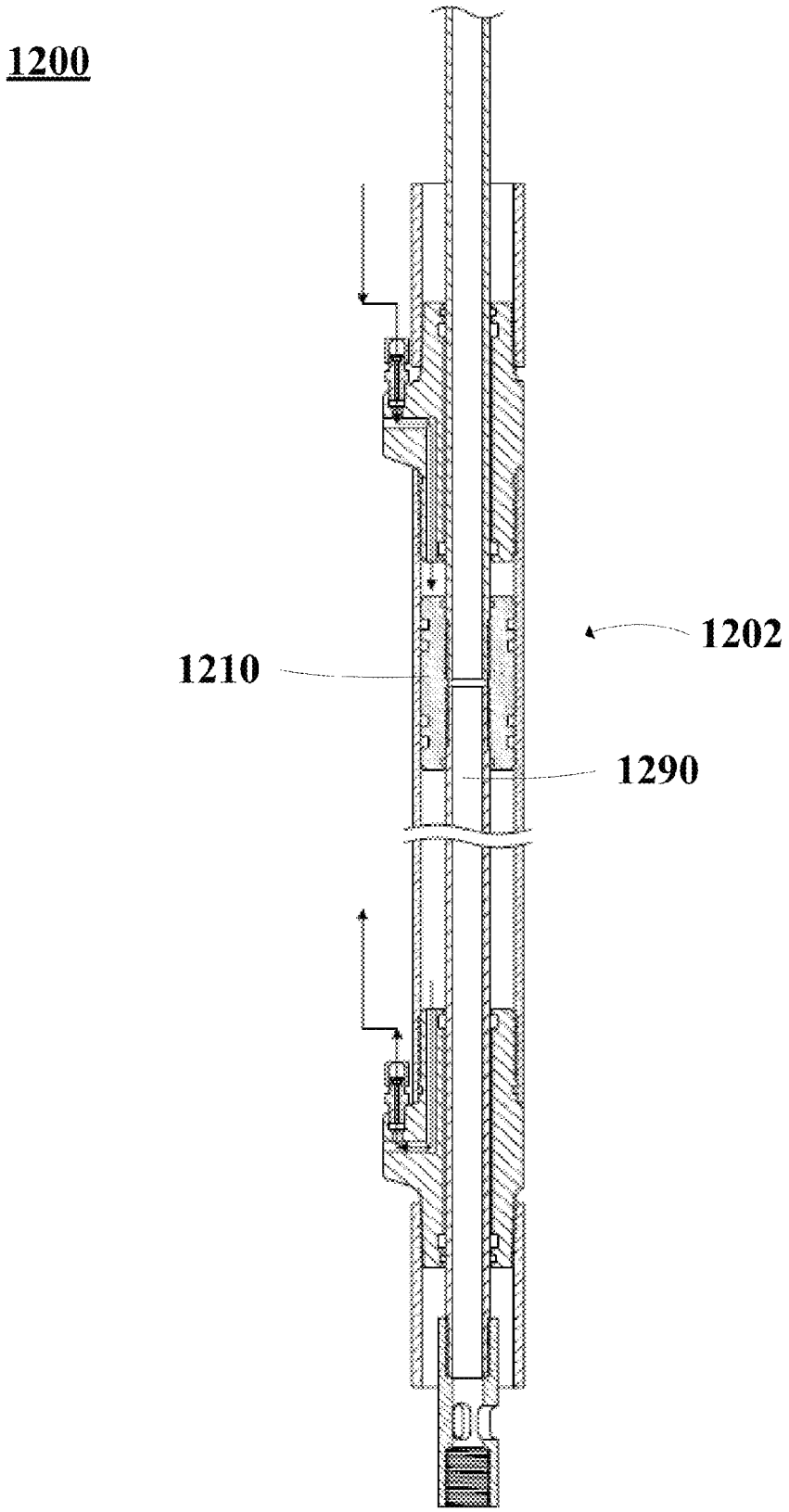
FIG. 11A depicts a partial cross-section flow diagram view of a hydraulic downhole rodless pump actuator in a system for artificial lift including apparatus having a downhole rodless pump actuator in accordance with embodiments.

FIG. 11A depicts a partial cross-section flow diagram view of a hydraulic downhole rodless pump actuator 1202 in a system 1200 for artificial lift in accordance with embodiments. The piston 1210 of the pump actuator 1202 is depicted in the "up" position and may be ready to be actuated downward via at least one fluid or pressurized gas.

Figure 11B:
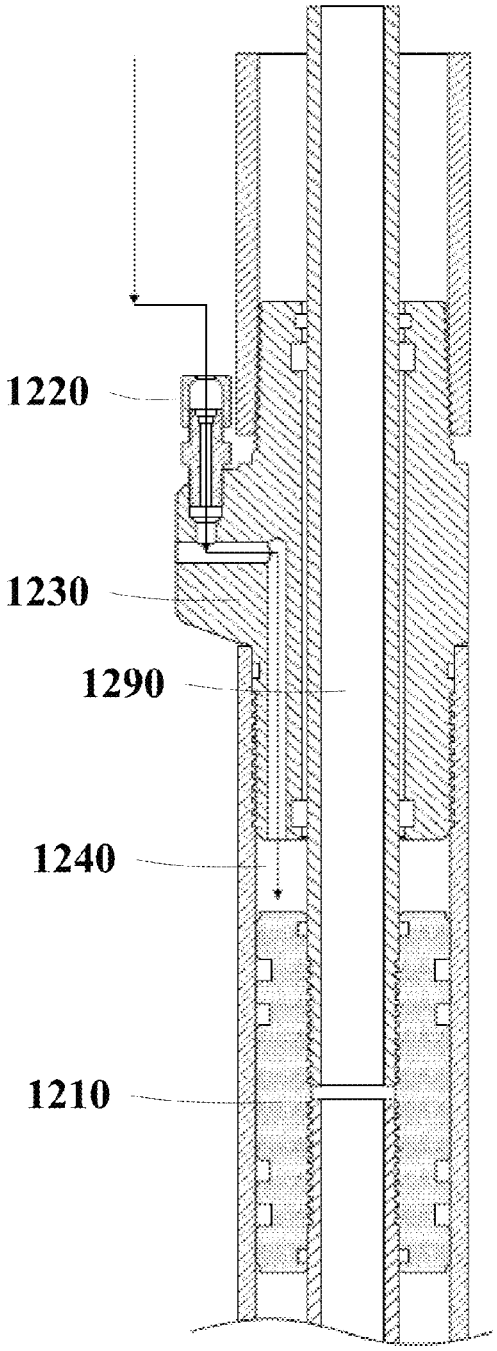
FIG. 11B depicts an enlarged top partial cross-section flow diagram view of a hydraulic downhole rodless pump actuator of FIG. 11A in a system for artificial lift including apparatus having a downhole rodless pump actuator in accordance with embodiments.
Figure 11C:
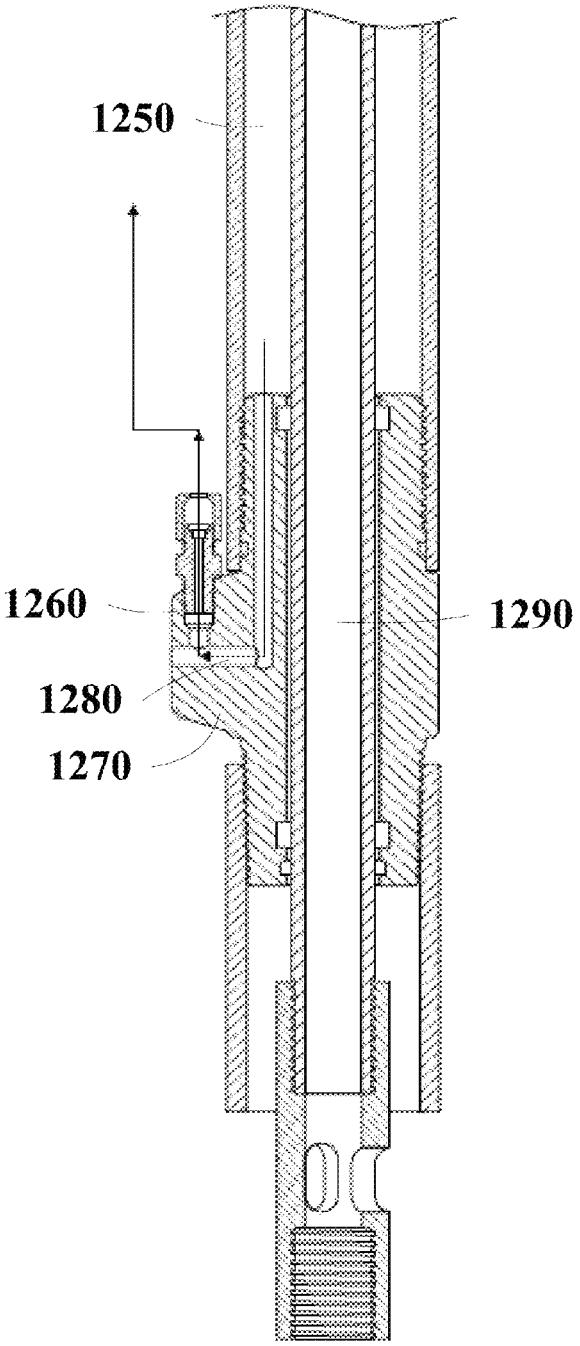
FIG. 11C depicts an enlarged bottom partial cross-section flow diagram view of a hydraulic downhole rodless pump actuator of FIG. 11A in a system for artificial lift including apparatus having a downhole rodless pump actuator in accordance with embodiments.

FIG. 11B depicts an enlarged top partial cross-section schematic flow diagram view of the hydraulic downhole rodless pump actuator 1202 of FIG. 11A. Hydraulic fluid or a pressurized gas may first enter the upper inlet portion 1220 of the pump actuator 1202 found on the left hand side of the pump actuator 1202 (the flow shown with arrows). The fluid may flow through a hollow portion of the upper end cap 1230 of the pump actuator 1202 (see FIG. 11A) and may flow into an upper chamber 1240 above the piston 1210. The pressure of the fluid or gas may push the piston 1210 in a downward direction, forcing fluid or gas in a lower chamber 1250 (below the piston 1210) out of the pump actuator 1202 and through a lower inlet portion 1260 via a hollow portion 1280 in the lower end cap 1270, as shown in FIG. 11C. The piston 1210 may be pushed downward into a "starting position." As the piston 1210 is pushed downward, the actuator rod 1290 may be pushed downward within the well (not depicted) due to the fact that the piston 1210 is directly affixed to the actuator rod 1290. In embodiments, the fluid entering and leaving the pump actuator 1202 may be the same type of fluid or pressurized gas. In embodiments, the fluid entering and leaving the pump actuator 1202 may each be different types of fluids.

Figure 12A:
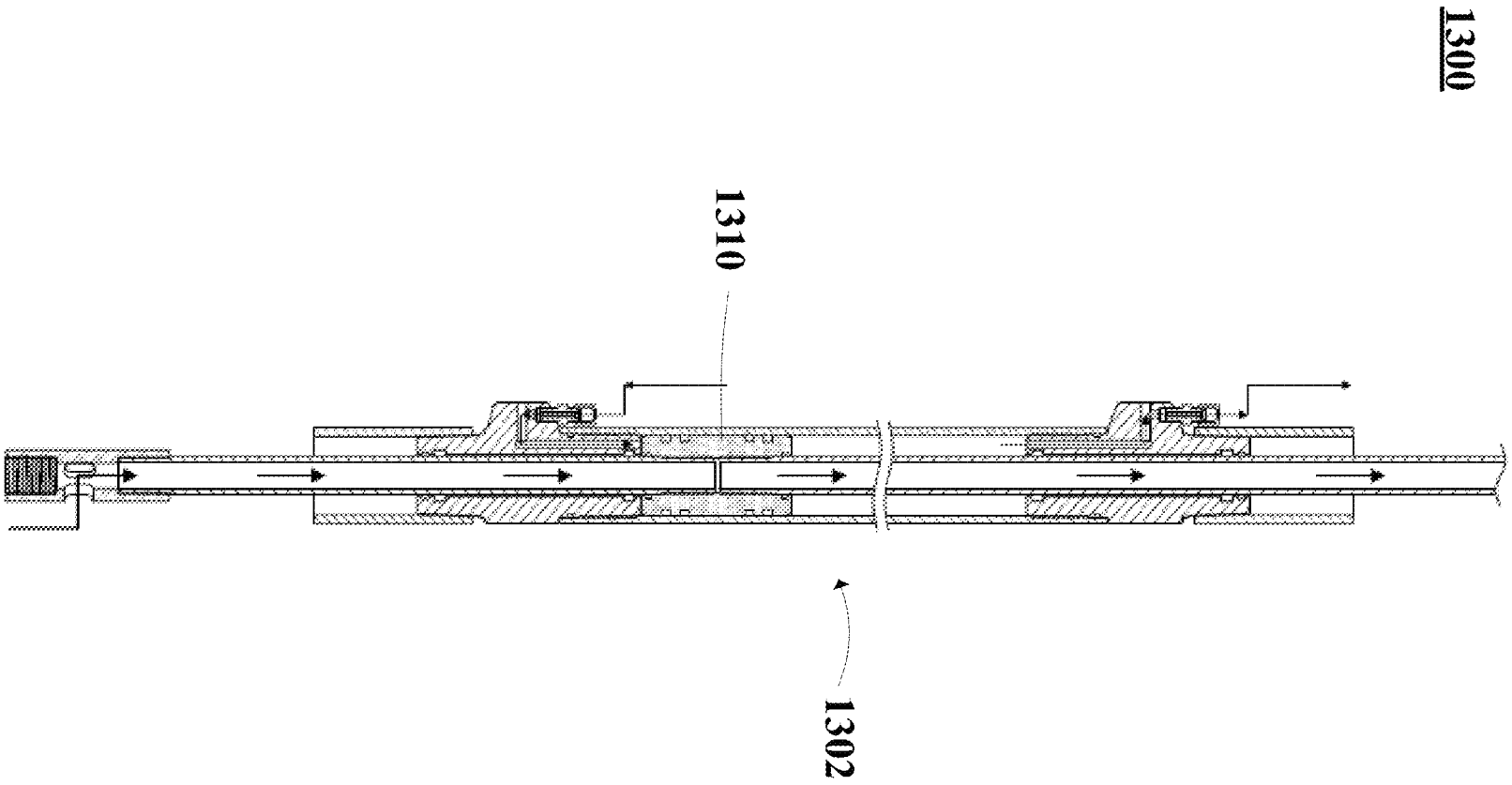
FIG. 12A depicts a partial cross-section flow diagram view of a hydraulic downhole rodless pump actuator in a system for artificial lift including apparatus having a downhole rodless pump actuator in accordance with embodiments.

FIG. 12A depicts a partial cross-section flow diagram view of a hydraulic downhole rodless pump actuator 1302 in a system 1300 for artificial lift in accordance with embodiments. The piston 1310 of the pump actuator 1302 is depicted in the "down" position and may be ready to be actuated upward via at least one fluid or pressurized gas.

Figure 12B:
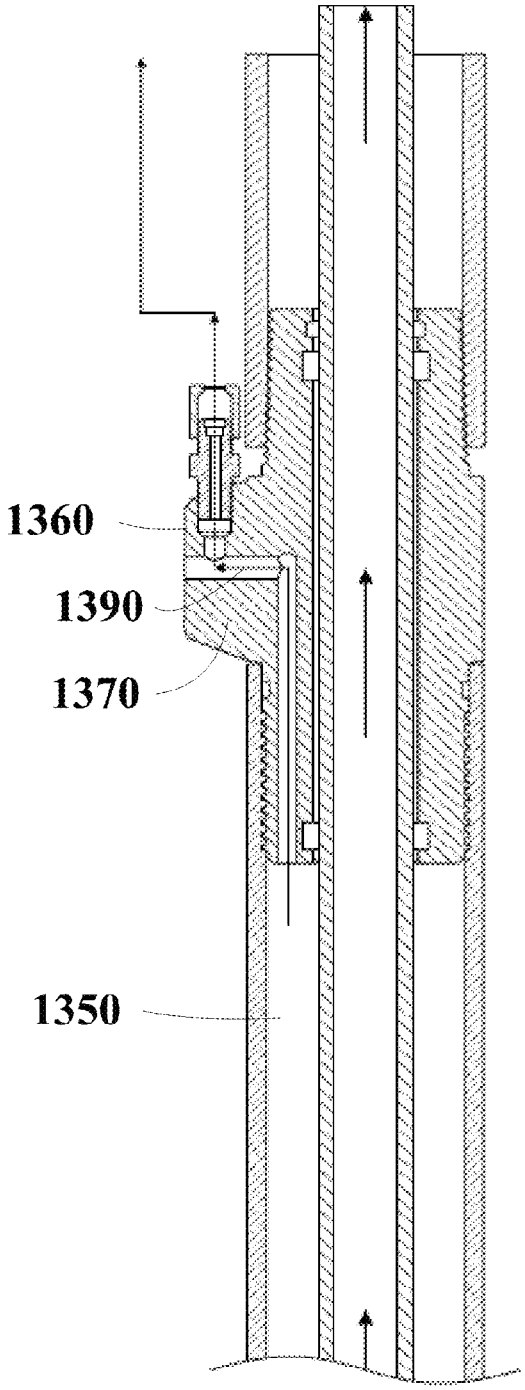
FIG. 12B depicts an enlarged top partial cross-section flow diagram view of a hydraulic downhole rodless pump actuator of FIG. 12A in a system for artificial lift including apparatus having a downhole rodless pump actuator in accordance with embodiments.
Figure 12C:
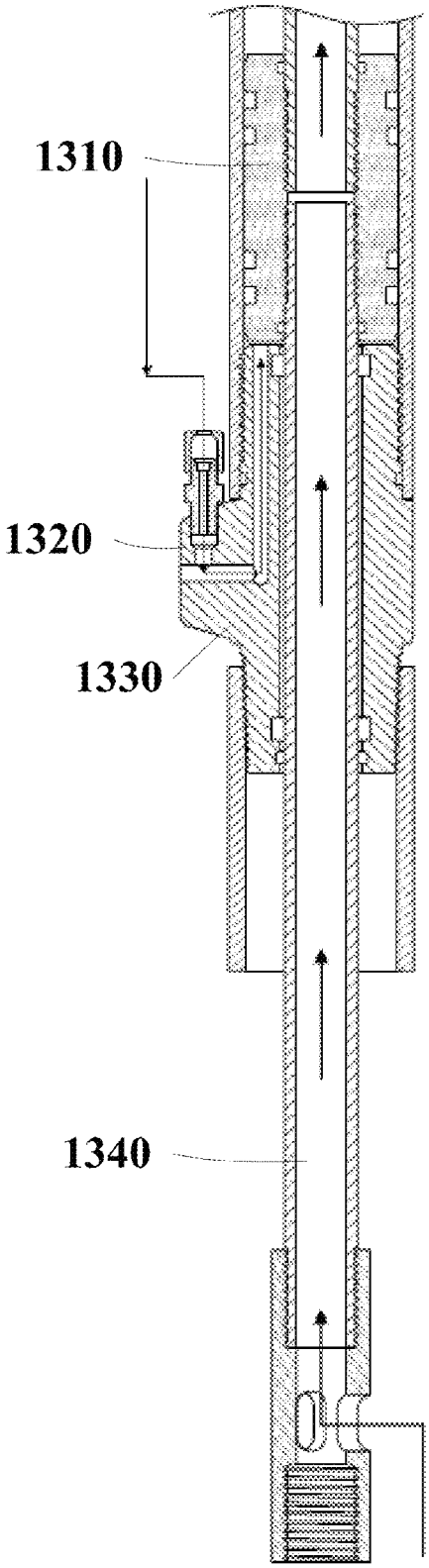
FIG. 12C depicts an enlarged bottom partial cross-section flow diagram view of a hydraulic downhole rodless pump actuator of FIG. 12A in a system for artificial lift including apparatus having a downhole rodless pump actuator in accordance with embodiments.

FIG. 12B depicts an enlarged top partial cross-section schematic flow diagram view of the hydraulic downhole rodless pump actuator 1302 of FIG. 12A. Hydraulic fluid or pressurized gas may first enter the lower inlet portion 1320 of the pump actuator 1302 found on the left hand side of the pump actuator 1302 (the flow shown with arrows), as shown in FIG. 12C. The fluid or gas may flow through a hollow portion of the lower end cap 1330 of the pump actuator 1302 and may flow into a lower chamber (not depicted) below the piston 1310. The pressure of the fluid or gas may push the piston 1310 in an upward direction, forcing fluid or gas in an upper chamber 1350 (above the piston 1310) out of the actuator and through an upper inlet portion 1360 via a hollow portion 1390 in an upper end cap 1370. The piston 1310 may be pushed upward until the piston 1310 cannot be pushed upward anymore. As the piston 1310 is pushed upward, the actuator rod 1340 may be pulled upward within the well (not depicted) due to the fact that the piston 1310 is directly affixed to the actuator rod 1340. Suction formed by this upward movement in the area of the well surrounding the exposed actuator rod 1340 may pull production fluid (not depicted) out of the well and through actuator rod 1340 orifices. The hydrocarbons may then flow upward through the actuator rod 1340 and up through the production tubing to the surface (not depicted). In embodiments, the fluid or gas entering and leaving the pump actuator 1302 may be the same type of fluid. In embodiments, the fluid entering and leaving the pump actuator 1302 may each be different types of fluids.

Figure 13A:
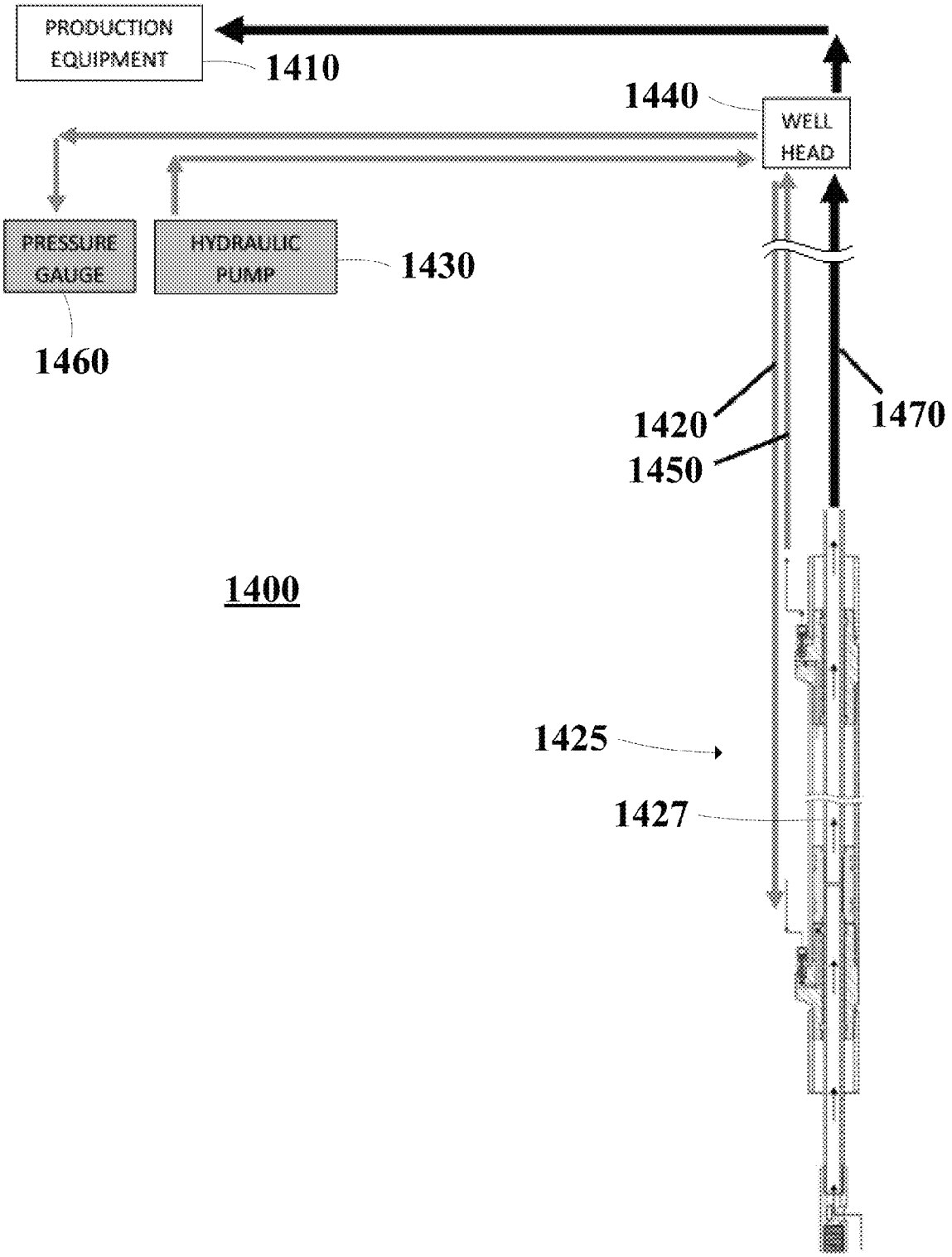
FIG. 13A depicts a schematic diagram of a system for artificial lift including apparatus having a downhole rodless pump actuation in accordance with embodiments and indicating flow of hydraulic fluids from the surface of a well to the actuator as moved in an up-stroke.

FIG. 13A depicts a schematic diagram of a system 1400 for artificial lift including a downhole rodless pump actuator 1425 in accordance with embodiments and indicating flow of hydraulic fluids from the surface (not depicted) of a well (not depicted) to the pump actuator 1425 as moved in an up-stroke. In embodiments, the actuator may be attached to a well's production tubing/equipment 1410 with a standard sucker rod pump (not depicted) attached to the actuator rod 1427. From the surface of the well, hydraulic fluids may be pumped into capillary line 1420 down to the pump actuator 1425 via the hydraulic pump 1430 and well head 1440. Simultaneously, pressurized gas may be forced out of the pump actuator 1425 and into capillary line 1450 to be monitored at the pressure gauge 1460 on the surface. As this occurs, production fluid (depicted as line 1470) may be pulled from the well through the actuator rod 1427, into production tubing 1410, and moved upwardly therethrough to the surface of the well. It is noted that the downhole rodless pump actuator 1425 may be, but is not limited to, in embodiments, the downhole rodless pump actuator of FIGS. 1A, 2, 3, 4A, 5A, 6A, 7A, 8, 11A, and 12A.

Figure 13B:
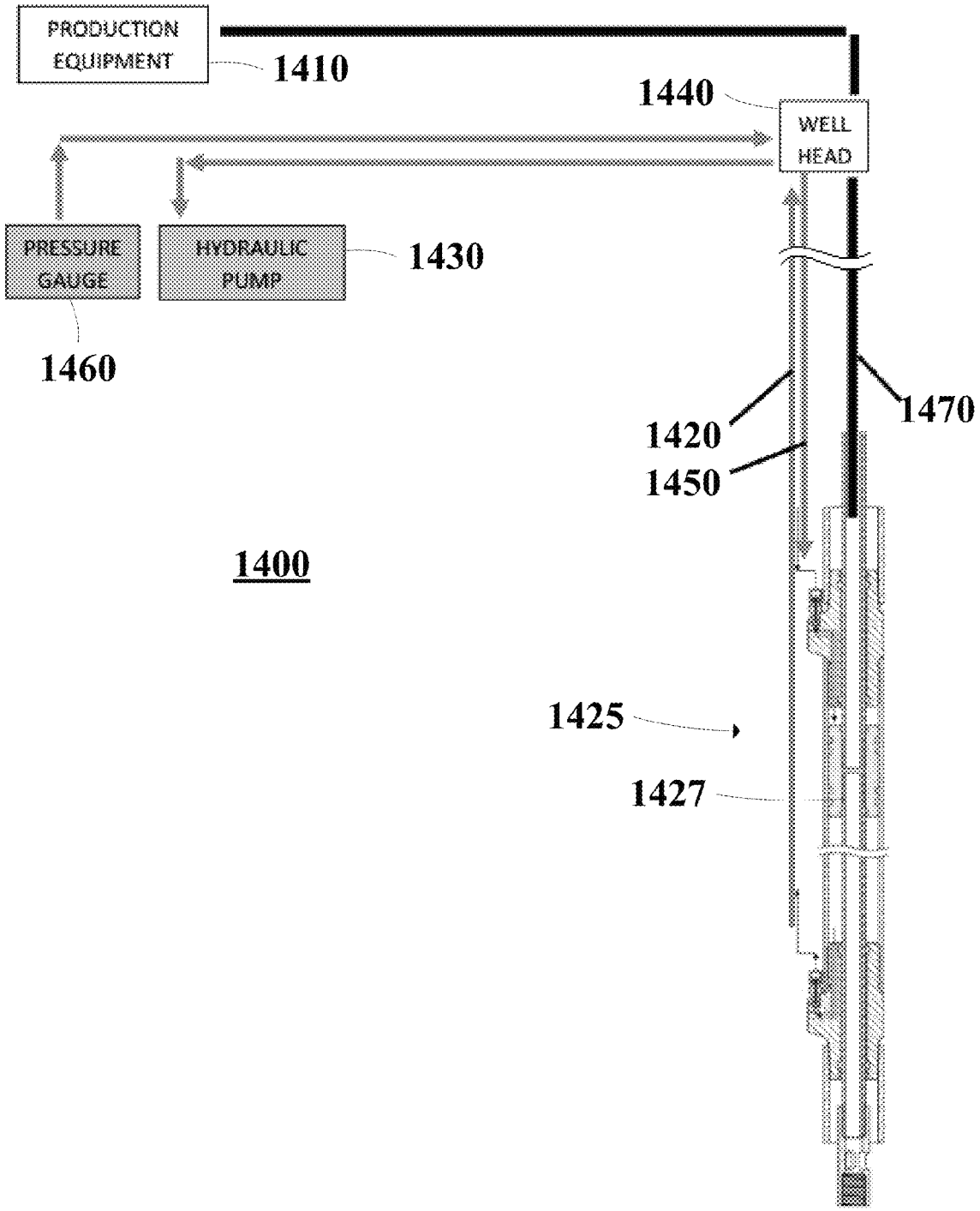
FIG. 13B depicts a schematic diagram of a system for artificial lift including apparatus having a downhole rodless pump actuation in accordance with embodiments and indicating flow of hydraulic fluids from the surface of a well to the actuator as moved in a down-stroke.

FIG. 13B depicts a schematic diagram of a system 1400 for artificial lift having a downhole rodless pump actuator 1425 in accordance with embodiments and indicating flow of hydraulic fluids from the surface of a well (not depicted) to the pump actuator 1425 as moved in a down-stroke. In embodiments, the pump actuator 1425 may typically be attached to a well's production tubing/equipment 1410 with a standard sucker rod pump (not depicted) attached to the actuator rod 1427. From the pump actuator 1425, pressurized gas in capillary line 1450 may force the hydraulic fluid out of the pump actuator 1425 and into capillary line 1420. Simultaneously, hydraulic fluid may be allowed to flow back to the hydraulic pump 1430 at the surface (not depicted). During this time, production fluid (depicted as line 1470) may remain stagnant until the beginning of the next up-stroke. It is noted that the pump actuator 1425 may be, but is not limited to, in embodiments, the downhole rodless pump actuator of FIGS. 1A, 2, 3, 4A, 5A, 6A, 7A, 8, 11A, and 12A.

In embodiments, at least one of the surface equipment and hydraulic pressure equipment may operate via at least one of a timer, pressure sensor, flow meter, or any number of measurement choices, to alternate between on and off cycles for the hydraulic pump 1430 at the surface to either pump hydraulic fluid to pump actuator 1425 (on) or to allow hydraulic fluid to return to the surface (off).

For the purposes of this disclosure, the terms "actuator tubing" and "actuator housing" may be synonymous.

For the purposes of this disclosure, the terms "pump actuator" and "apparatus" may be synonymous.

The disclosed subject matter provides a system, apparatus and method for artificial lift. Embodiments of disclosed subject matter provide a system, apparatus and method for artificial lift including a hydraulic downhole rodless pump actuator. Embodiments may provide energy and cost savings, reduced maintenance, reduced maintenance time, reduced maintenance expense, reduced complexity, increased precision of control, increased precision of actuation, increased useful life of artificial lift equipment, reduced mechanical loads on equipment, and apparatus and systems of simplified construction and operation.

In accordance with the preceding, one of ordinary skill in the art will understand that embodiments provide improved energy consumption for pumping, cost savings for operation, reduced maintenance, reduced maintenance time, reduced maintenance expense, reduced complexity, increased precision of control of pumping operations, increased precision of actuation, reduced mechanical loads on equipment, elimination of sucker rod strings for actuation, and simplified construction and operation.

While this disclosure has been particularly shown and described with reference to preferred embodiments thereof and to the accompanying drawings, it will be understood by those skilled in the art that various changes in form and details may be made therein without departing from the spirit of this disclosure. Therefore, the scope of the disclosure is defined not by the detailed description but by the appended claims.

What is claimed is:

1. A system for artificial lift, said system comprising:

a well comprising production tubing having a pipe wall defining therein an open production tubing interior space, the pipe wall at a bottom end thereof having a set of production tubing internal threads; a well head;

surface production equipment in communication with the well head to receive production fluid from the well;

a nitrogen gas supply providing pressurized nitrogen gas to an outlet capillary line;

a pressure gauge sensing pressure of nitrogen gas in the outlet capillary line;

a hydraulic pump pressurizing hydraulic fluid in an inlet capillary line;

a pressure gauge sensing pressure of hydraulic fluid in the inlet capillary line;

an actuator housing comprising an actuator housing tubular wall, the actuator housing tubular wall comprising an actuator housing upper end in spaced opposed relationship to an actuator housing lower end, the actuator housing upper end having a set of upper end internal threads, the actuator housing lower end having a set of lower end internal threads, from the upper end internal threads to the lower end internal threads the actuator housing tubular wall having uniform uninterrupted solid wall structure, the actuator housing having an actuator housing interior space defined inside the actuator housing tubular wall;

an actuator rod housed at least partially within the actuator housing, the actuator rod having an elongated actuator rod tubular wall defining an actuator rod interior tubular flow path isolated from the actuator housing, the actuator rod interior tubular flow path extending from an actuator rod lower end to an actuator rod upper end, the actuator rod interior tubular flow path open to carry production fluid from the actuator rod lower end to the actuator rod upper end;

an actuator piston fixedly coupled to the actuator rod for reciprocating movement in common with the actuator rod along a longitudinal axis, the actuator piston disposed in sealing relationship with the actuator rod tubular wall, the actuator piston disposed within the actuator housing in sealing relationship with the actuator housing tubular wall, the actuator piston subdividing the actuator housing interior space along the longitudinal axis into a lower chamber and an upper chamber isolated therefrom, the lower chamber and upper chamber changing volume upon reciprocating movement of the actuator piston to carry the actuator rod;

an upper end cap fixedly coupled to the actuator housing upper end, the upper end cap having an upper set of external threads disposed in opposition to a lower set of external threads, the upper set of external threads mating in sealed threaded relationship with the production tubing internal threads to fixedly couple the upper end cap to the bottom end of the production tubing, the lower set of external threads mating in sealed threaded relationship with the upper end internal threads of the actuator housing, the upper end cap having a central aperture receiving the actuator rod, the upper end cap engaged in sealing relationship with the actuator rod tubular wall;

the actuator rod upper end terminating above the upper end cap in the production tubing interior space to carry production fluid into the production tubing above the upper end cap;

a lower end cap fixedly coupled to the actuator housing lower end, the lower end cap having an upper set of external threads disposed in opposition to a lower set of external threads, the upper set of external threads mating in sealed threaded relationship with the lower end internal threads of the actuator housing to fixedly couple the lower end cap to the lower end of the actuator housing, the lower set of external threads mating in sealed threaded relationship with a pump barrel of a plunger pump to align the actuator housing lower end with the pump barrel at the lower end cap, the lower end cap having a central aperture receiving the actuator rod, the lower end cap engaged in sealing relationship with the actuator rod tubular wall;

the actuator rod lower end terminating below the lower end cap to carry production fluid from below the lower end cap into the actuator rod interior tubular flow path;

an outlet capillary line fixedly coupled to the upper end cap, the outlet capillary line supplying and removing pressurized nitrogen gas from the upper chamber within the actuator housing;

an inlet capillary line fixedly coupled to the lower end cap, the inlet capillary line extending to the lower end cap outside the actuator housing tubular wall, the inlet capillary line supplying and removing hydraulic fluid from the lower chamber within the actuator housing; and a tubular coupling having a coupling first end disposed in opposition to a coupling second end, the tubular coupling having a coupling interior passage defined by a coupling sidewall, the coupling interior passage extending from the coupling first end to the coupling second end, the tubular coupling at the coupling first end joined to the actuator rod lower end, the tubular coupling at the coupling second end directly connected to the plunger of the plunger pump to drive reciprocating movement of the plunger in relation to reciprocation of the actuator rod to lift production fluid in the well, the tubular coupling having a coupling sidewall aperture defined through the coupling sidewall, the coupling sidewall aperture providing open fluid communication between the coupling interior passage and a production fluid accumulation space, the production fluid accumulation space being outside the coupling sidewall below the lower end cap, the coupling interior passage providing an open flow path for production fluid to flow upward through the tubular coupling into the actuator rod tubular flow path, the coupling sidewall aperture providing an open flow path for accumulation in the production fluid accumulation space of production fluid lifted by the plunger.

2. The system of claim 1, further comprising an upper O-ring sealing between the actuator rod tubular wall and the upper end cap.

3. The system of claim 1, further comprising a lower O-ring sealing between the actuator rod tubular wall and the lower end cap.

4. The system of claim 1, wherein pressurization of hydraulic fluid in the inlet capillary line and pressurization of nitrogen gas in the outlet capillary line actuate cyclical pumping movement of the piston affixed to the actuator rod to displace production fluid by driving movement of the plunger via the tubular coupling.

5. The system of claim 1, further comprising the piston affixed to a piston wedge affixed to the actuator rod via a plurality of extraction bolts, the piston wedge applying compression and resultant clamping forces to the actuator rod.

6. An apparatus for extracting fluid from an underground area comprising a well comprising production tubing having a pipe wall defining therein an open production tubing interior space, the pipe wall at a bottom end thereof having a set of production tubing internal threads, said apparatus comprising:

an actuator housing comprising an actuator housing tubular wall, the actuator housing tubular wall comprising an actuator housing upper end in spaced opposed relationship to an actuator housing lower end, the actuator housing upper end having a set of upper end internal threads, the actuator housing lower end having a set of lower end internal threads, from the upper end internal threads to the lower end internal threads the actuator housing tubular wall having uniform uninterrupted solid wall structure, the actuator housing having an actuator housing interior space defined inside the actuator housing tubular wall;

an actuator rod housed at least partially within the actuator housing, the actuator rod having an elongated actuator rod tubular wall defining an actuator rod interior tubular flow path isolated from the actuator housing, the actuator rod interior tubular flow path extending from an actuator rod lower end to an actuator rod upper end, the actuator rod interior tubular flow path open to carry production fluid from the actuator rod lower end to the actuator rod upper end;

an actuator piston fixedly coupled to the actuator rod for reciprocating movement in common with the actuator rod along a longitudinal axis, the actuator piston disposed in sealing relationship with the actuator rod tubular wall, the actuator piston disposed within the actuator housing in sealing relationship with the actuator housing tubular wall, the actuator piston subdividing the actuator housing interior space along the longitudinal axis into a lower chamber and an upper chamber isolated therefrom, the lower chamber and upper chamber changing volume upon reciprocating movement of the actuator piston to carry the actuator rod;

an upper end cap fixedly coupled to the actuator housing upper end, the upper end cap having an upper set of external threads disposed in opposition to a lower set of external threads, the upper set of external threads mating in sealed threaded relationship with the production tubing internal threads to fixedly couple the upper end cap to the bottom end of the production tubing, the lower set of external threads mating in sealed threaded relationship with the upper end internal threads of the actuator housing, the upper end cap having a central aperture receiving the actuator rod, the upper end cap engaged in sealing relationship with the actuator rod tubular wall;

the actuator rod upper end terminating above the upper end cap in the production tubing interior space to carry production fluid into the production tubing above the upper end cap;

a lower end cap fixedly coupled to the actuator housing lower end, the lower end cap having an upper set of external threads disposed in opposition to a lower set of external threads, the upper set of external threads mating in sealed threaded relationship with the lower end internal threads of the actuator housing to fixedly couple the lower end cap to the lower end of the actuator housing, the lower set of external threads mating in sealed threaded relationship with a pump barrel of a plunger pump to align the actuator housing lower end with the pump barrel at the lower end cap, the lower end cap having a central aperture receiving the actuator rod, the lower end cap engaged in sealing relationship with the actuator rod tubular wall;

the actuator rod lower end terminating below the lower end cap to carry production fluid from below the lower end cap into the actuator rod interior tubular flow path;

an outlet capillary line fixedly coupled to the upper end cap outside the actuator housing, the outlet capillary line supplying and removing pressurized nitrogen gas from the upper chamber within the actuator housing;

an inlet capillary line fixedly coupled to the lower end cap outside the actuator housing, the inlet capillary line extending to the lower end cap outside the actuator housing tubular wall, the inlet capillary line supplying and removing hydraulic fluid from the lower chamber within the actuator housing; and a tubular coupling having a coupling first end disposed in opposition to a coupling second end, the tubular coupling having a coupling interior passage defined by a coupling sidewall, the coupling interior passage extending from the coupling first end to the coupling second end, the tubular coupling at the coupling first end directly connected to the actuator rod lower end, the tubular coupling at the coupling second end joined to the plunger of the plunger pump to drive reciprocating movement of the plunger in relation to reciprocation of the actuator rod to lift production fluid in the well, the tubular coupling having a coupling sidewall aperture defined through the coupling sidewall, the coupling sidewall aperture providing open fluid communication between the coupling interior passage and a production fluid accumulation space, the production fluid accumulation space being outside the coupling sidewall below the lower end cap, the coupling interior passage providing an open flow path for production fluid to flow upward through the tubular coupling into the actuator rod tubular flow path, the coupling sidewall aperture providing an open flow path for accumulation in the production fluid accumulation space of production fluid lifted by the plunger.

7. The apparatus of claim 6, further comprising an upper O-ring sealing between the actuator rod tubular wall and the upper end cap.

8. The apparatus of claim 6, further comprising a lower O-ring sealing between the actuator rod tubular wall and the lower end cap.

9. The apparatus of claim 6, wherein pressurization of hydraulic fluid in the inlet capillary line and pressurization of nitrogen gas in the outlet capillary line actuate cyclical pumping movement of the piston affixed to the actuator rod to displace production fluid by driving movement of the plunger via the tubular coupling.

10. The apparatus of claim 6, further comprising the piston affixed to a piston wedge affixed to the actuator rod via a plurality of extraction bolts, the piston wedge applying compression and resultant clamping forces to the actuator rod.

* * * * *